United States Patent [19]

Stefanek

[11] Patent Number: 4,593,543

[45] Date of Patent: Jun. 10, 1986

[54] SECURITY LOCK

[75] Inventor: Ronald T. Stefanek, Lockport, Ill.

[73] Assignee: Folger Adam Company, Lemont, Ill.

[21] Appl. No.: 539,331

[22] Filed: Oct. 5, 1983

[51] Int. Cl.[4] ..... E05B 65/06

[52] U.S. Cl. ..... 70/134; 70/150; 70/280; 292/144; 292/169.13

[58] Field of Search ..... 70/107, 134, 150, 151 R, 70/277, 278, 279, 280, 281, 282; 292/144, 169.13, 201

[56] References Cited

U.S. PATENT DOCUMENTS

| | | | |
|---|---|---|---|
| 563,867 | 7/1896 | Moser . | |
| 656,808 | 8/1900 | Carleton . | |
| 1,128,392 | 2/1915 | VanWinkle . | |
| 1,195,713 | 8/1916 | Page . | |
| 1,569,228 | 1/1926 | Hurd . | |
| 1,611,838 | 12/1926 | Malicki . | |
| 1,635,028 | 7/1927 | Burr et al. . | |
| 2,800,347 | 7/1957 | Wardwell, Jr. | 292/169 |
| 3,148,525 | 9/1964 | Durant . | |
| 3,157,042 | 11/1964 | Wolz | 70/279 |
| 3,211,486 | 10/1965 | Crandell | 292/169.13 |
| 3,353,383 | 11/1967 | Fish | 70/151 |
| 3,390,908 | 7/1968 | Schlage | 292/195 |
| 3,432,631 | 3/1969 | Deutscher et al. | 200/61.67 |
| 3,751,086 | 8/1973 | Geringer | 292/144 |
| 3,751,088 | 8/1973 | Schlage et al. . | |
| 3,792,888 | 2/1974 | Kambic | 292/144 |
| 3,796,073 | 3/1974 | Guiraud | 70/134 |
| 3,890,608 | 6/1975 | Peterson . | |
| 3,999,411 | 12/1976 | Kambic | 70/144 |
| 4,180,287 | 12/1979 | Youngblood | 292/144 |
| 4,237,711 | 12/1980 | Kambic . | |

*Primary Examiner*—Robert L. Wolfe

*Attorney, Agent, or Firm*—Willian Brinks Olds Hofer Gilson & Lione

[57] ABSTRACT

A solenoid-operated door lock has a pivotally mounted deadlock lever which can lock either a latchbolt or a deadbolt. The locking and release movement of the deadlock lever is controlled by pivoting a release lever which is biased by a spring to maintain the deadlock lever in its selected operating positions. A solenoid-controlled main operating lever pivots to extend or retract the latchbolt or deadbolt through a lost motion connection. The lost motion connection ensures that the deadlock lever is moved to its release position before the latchbolt or deadbolt is retracted into the lock. The lock includes a triggerbolt which is extended when the door is open and is pushed into the lock when the door is closed. Switches are provided to monitor the operational condition of the lock and the position of the door. Indicator lights are provided at a remote guard station to show the operational condition of the lock. A switch is also provided to control the energization current of the solenoid. A thermal protector operates the solenoid at a reduced current for as long as a dangerously high solenoid temperature is detected. A switch is provided to allow an inmate or a guard to electrically unlock the lock, if the switch is activated by the remote guard station.

74 Claims, 36 Drawing Figures

FIG. 1A
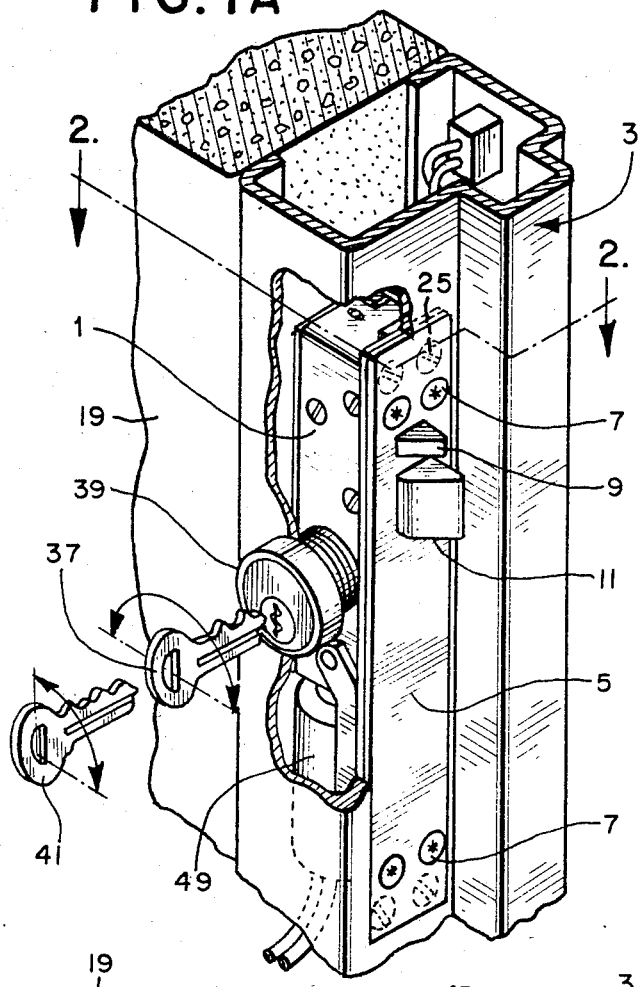
FIG. 1B
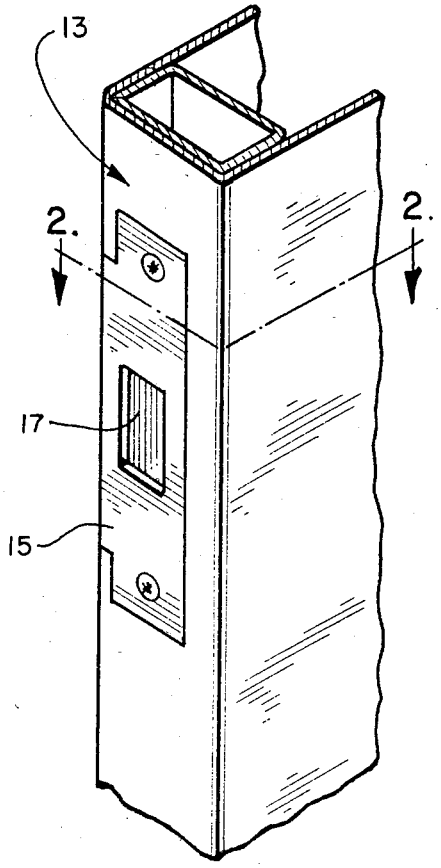
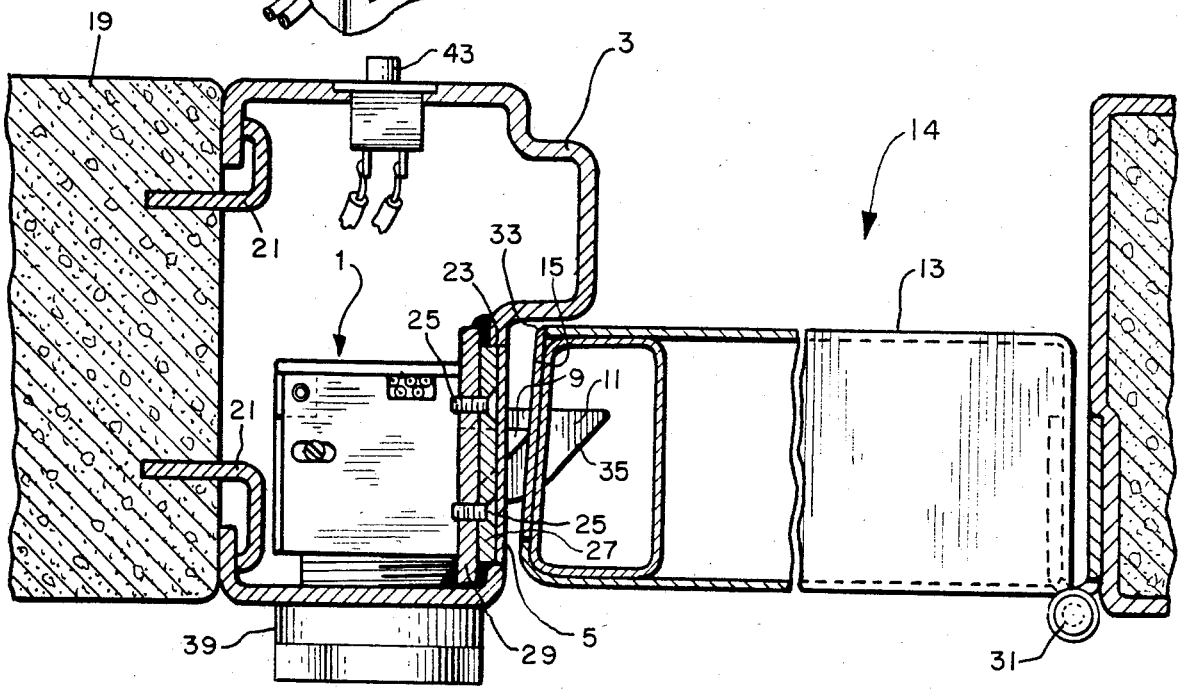
FIG. 2

FIG. 7
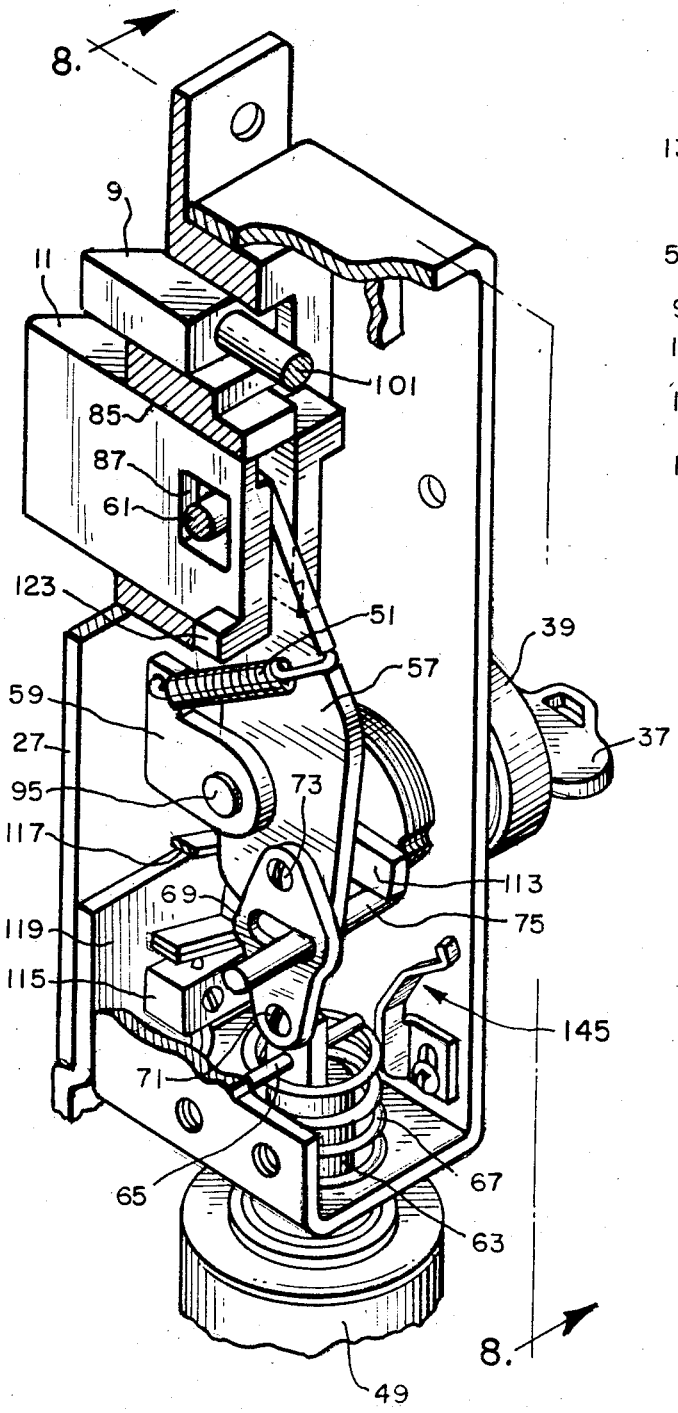
FIG. 8
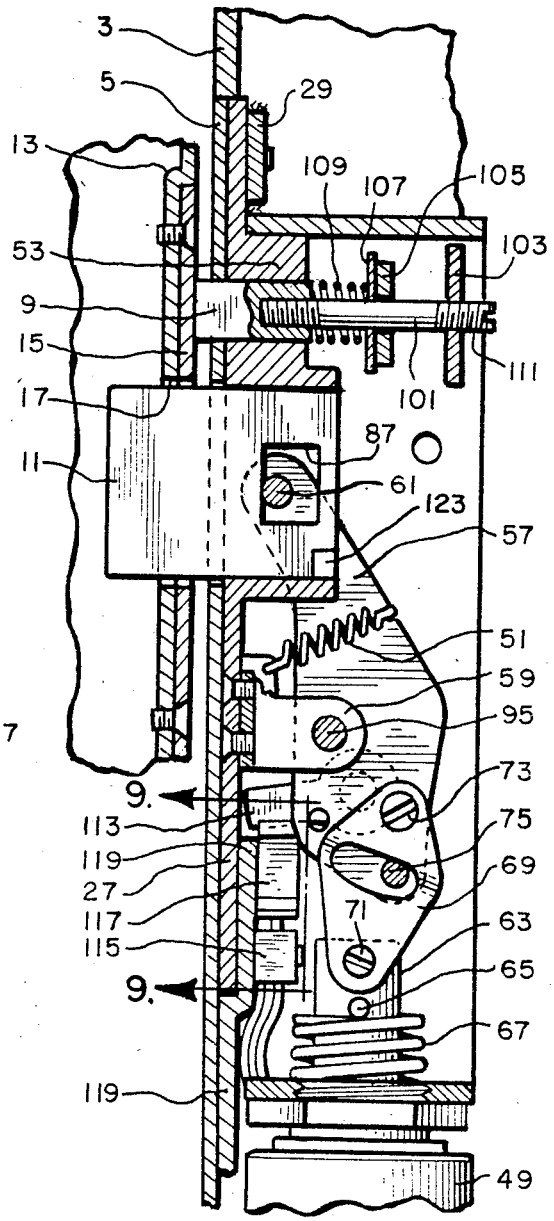
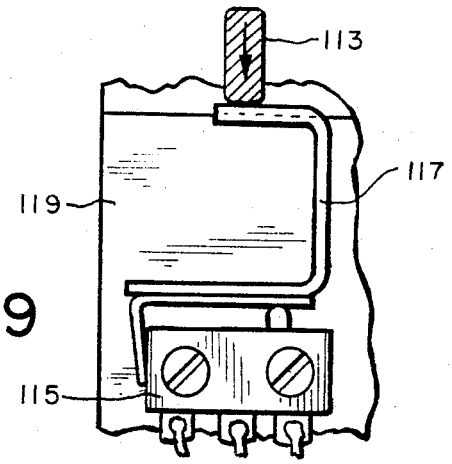
FIG. 9

FIG. 10A
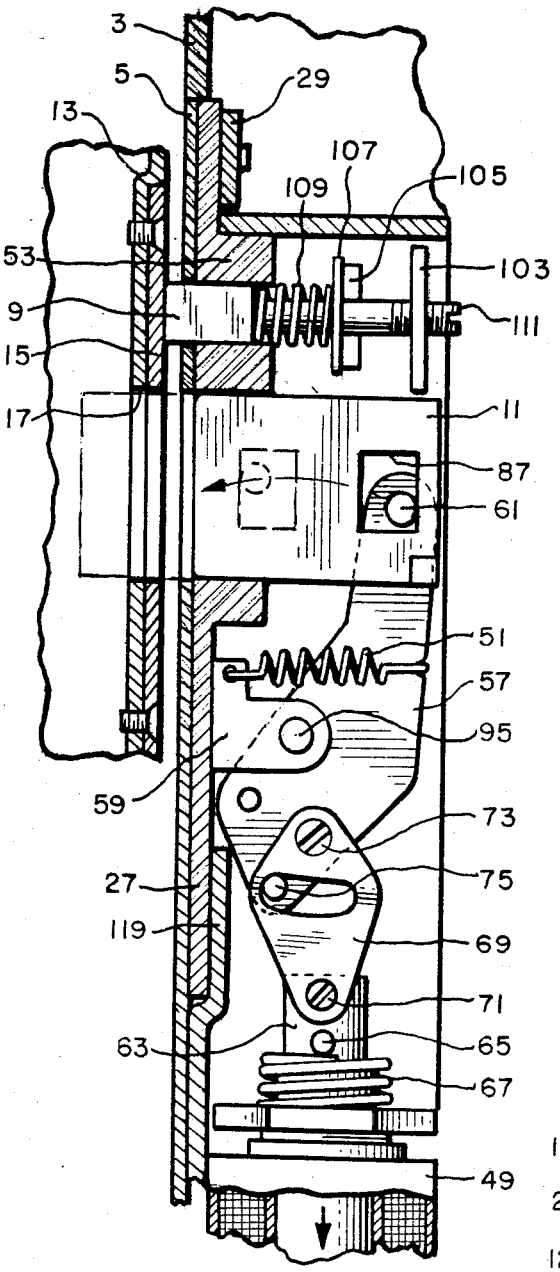
FIG. 10B
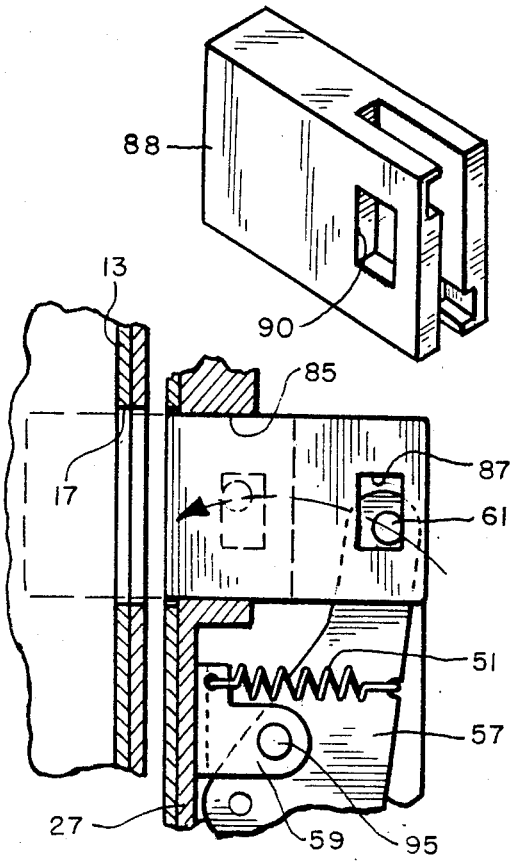
FIG. 10C
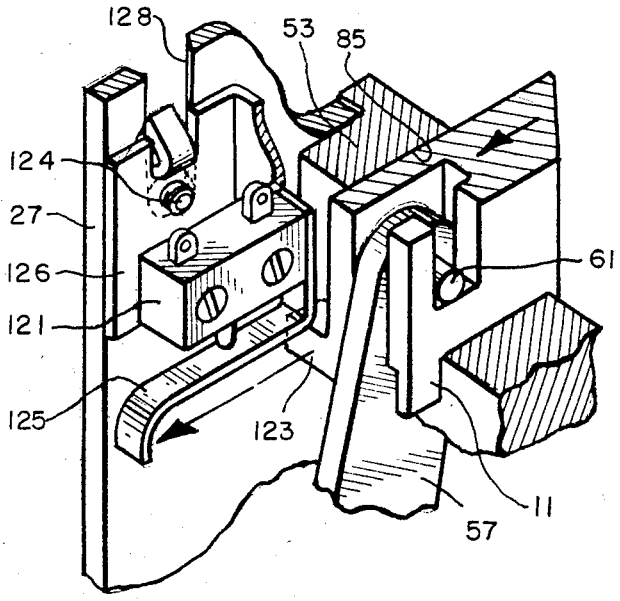
FIG. 11

FIG.12
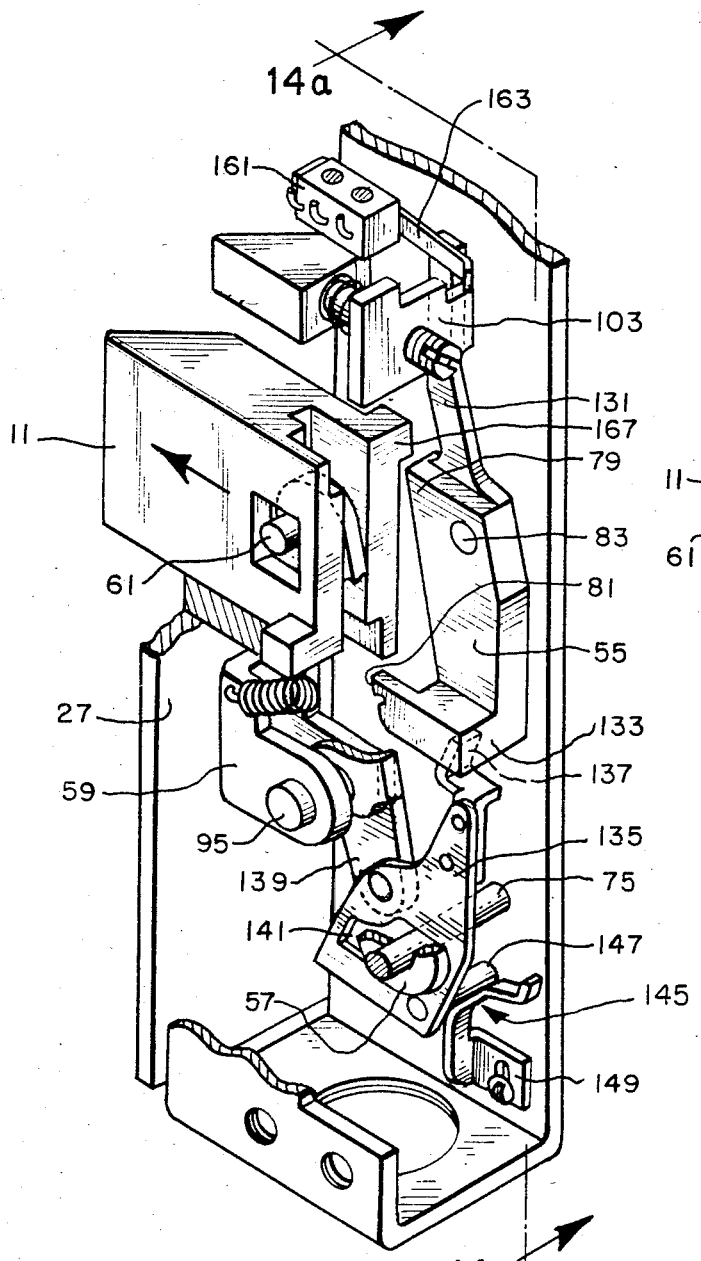
FIG.14A
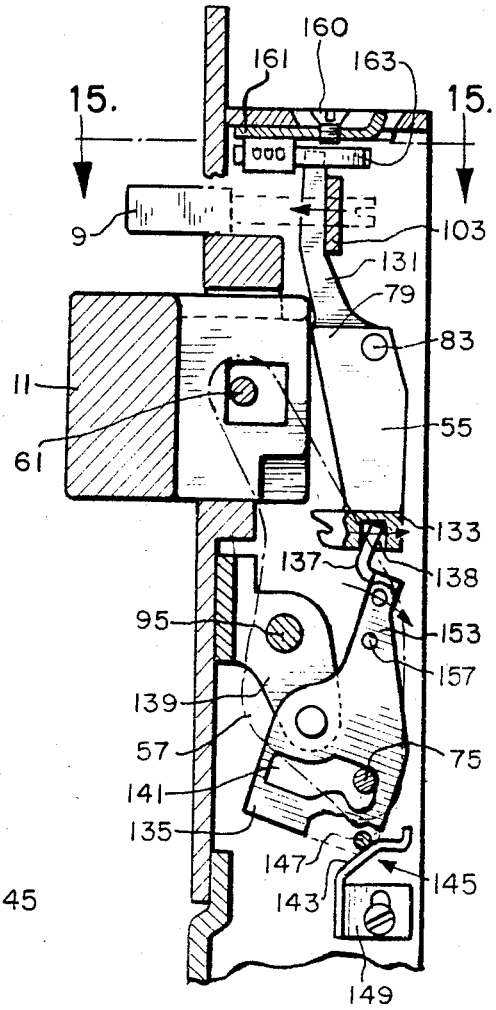
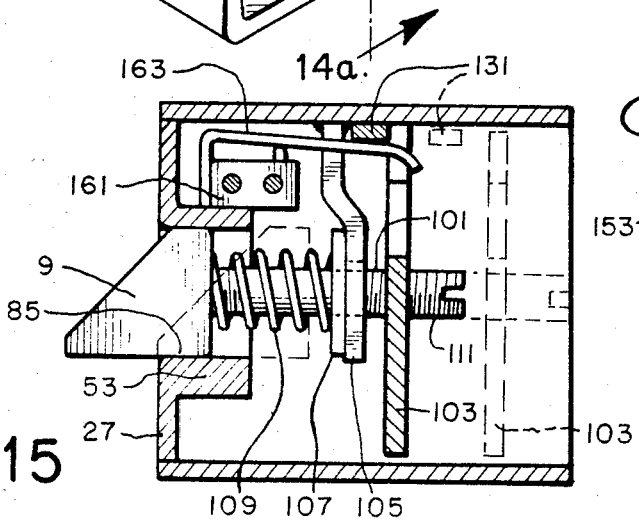
FIG. 15
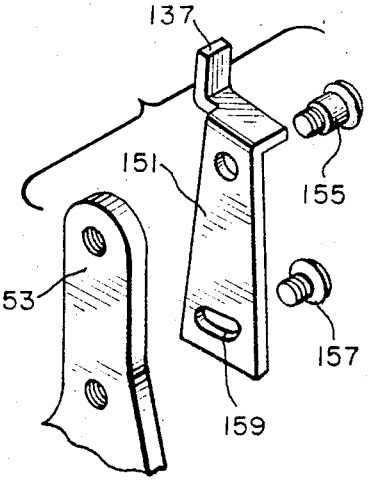
FIG.13

SECURITY LOCK

TECHNICAL FIELD

The invention relates to a solenoid-actuated locking mechanism which controls access to rooms or cells, particularly for institutional applications such as minimum security prisons or high security commercial installations. More particularly, the invention relates to an improved deadlocking mechanism which is electrically operated in either a fail-secure or fail-safe mode.

BACKGROUND OF THE INVENTION

Secured institutions such as minimum security prisons or high security commercial installations have many cells or rooms which must be individually locked and unlocked for controlled access of inmates, patients or employees. It is generally desirable in such systems to provide a central control center, for example a guard station, which monitors the conditions of each individual lock and which remotely and selectively locks and unlocks the doors, for example by means of solenoids.

In present security locking systems, a solenoid is coupled to a lock mechanism and is energized and de-energized to control the movement of the latchbolt or deadbolt of the lock. If the locking mechanism is constructed or "fail-safe" operation, the latchbolt or deadbolt is mechanically biased to unlock the door when the solenoid is de-energized. Thus, the door will remain locked only for so long as the solenoid is energized.

If the locking mechanism is constructed for operation in a "fail-secure" mode, the latchbolt or deadbolt is mechanically biased to lock the door when the solenoid is de-energized. Thus, if power fails, the door remains locked.

Solenoid-actuated locks have heretofore required different mechanical and electrical designs to provide fail-secure or fail-safe modes of operation. Thus, lock manufacturers have had to maintain separate parts inventories and have had to use different assembly operations for fail-safe and fail-secure types of locks. These relatively expensive manufacturing and inventory requirements have added to the cost of the locks. In addition, if a security institution at some point desires to change the mode of operation of its locks, a substantial amount of time has been required to replace or modify locking mechanisms to achieve the desired change in function.

Accordingly, it is an object of the invention to provide a solenoid-actuated security lock which can be easily modified to operate in either the fail-safe or fail-secure mode.

It is another object of the invention to provide such a lock which is relatively simple to construct and which is reliable in operation.

A further object of the invention is to provide a security lock which has essentially the same components and assembly operations for either its fail-safe or fail-secure versions.

In institutional locks it is desirable and in many cases mandatory to provide a deadlock lever mechanism for mechanically blocking retraction of an extended deadbolt or latchbolt. The blocking action of the deadlock lever prevents an inmate from unlocking the door by forcing the latchbolt or deadbolt back into its casing. The deadlock lever thus provides a positive locking operation and resists tampering which might otherwise result in unlocking a secured door.

Industry design standards also require a relatively small thickness or profile for the housing of a lock. In order to provide a lock with a low profile housing and deadlocking capability, it has been necessary in many cases to use deadbolts and latchbolts with a relatively small extension or "throw" of, for example, less than three-quarters of an inch (1.905 cm). A bolt throw of at least three-quarters of an inch should be required for most medium security applications and in some cases the throw should be extended to one inch (2.54 cm).

Accordingly, it is an object of the invention to provide a relatively low profile lock which uses a bolt with either a three-quarter or a one inch extension.

From a manufacturing standpoint, it is desirable to provide a lock which can operate with either a three-quarter inch latchbolt or a one inch deadbolt, in order to accommodate the differing requirements of security institutions. However, it has been difficult to provide a single mechanism which will operate reliably with bolts having different throw lengths, because a change in throw length can alter the timing of movement of components within the lock.

Accordingly, it is a further object of the invention to provide a locking mechanism which can be easily modified to reliably utilize either a one inch deadbolt or a three-quarter inch latchbolt.

If a latchbolt is used in association with a deadlock lever, it is desirable to provide a symmetrical engagement of the lever and the bolt to ensure a positive blocking action. If the deadlock lever is of a pivoting type, it is particularly important to provide contact with the latchbolt on opposite sides of the lever's pivot point.

Accordingly, it is another object of the invention to provide a locking mechanism with a pivoting deadlock lever which contacts a latchbolt at points on opposite sides of the pivot point of the lever.

It has been found convenient in prior art locks to employ a bolt which supports its deadlock lever when the bolt is retracted into the housing of the lock. Thus, when the bolt is retracted, it will slide over the deadlock lever until it reaches it fully retracted position. This sliding engagement is undesirable, because it frictionally resists retraction of the bolt and could conceivably result in binding between the latchbolt and deadlock lever.

Accordingly, it is an object of the invention to provide an improved security lock wherein the deadlock lever is spaced from its associated latchbolt or deadbolt. The spaced relation of the components ensures that the bolt can be easily and fully extended to provide a positive deadlock and can be easily retracted into the lock housing to unlock a door.

Binding between a latchbolt or deadbolt and the deadlock lever can also occur if the lever fails to move away from the bolt when the bolt is being retracted within the lock housing to unlock a door. It is therefore an object of the invention to provide a lock with a relatively simple and reliable mechanism which allows full disengagement of the lever from the bolt before the bolt is retracted into the housing of the lock.

A security lock may malfunction if its switch components shift slightly in position as a result of vibration. Malfunctions of this type are typically corrected by the costly and time consuming process of disassembling the lock and replacing or realigning the components.

It is therefore an object of the invention to provide a lock with switch components which can be easily adjusted to position without opening the housing of the lock.

Malfunctions can also occur as a result of wear of lock components in use. Malfunctions of this type have typically required replacement of the component or of the entire lock.

It is therefore an object of the invention to provide a lock with components which can be adjusted to compensate for wear.

In field installation of locks, the gap between doors and associated doorjambs may vary considerably from door to door. If a lock has a triggerbolt with a fixed extension, the variation in door gap can provide serious installation problems. Moreover, in field installation, doors may have strikeplates oriented in reversed positions. If a lock has a triggerbolt which is supported in a fixed orientation, it can be used only with doors having strikeplates aligned to accept this particular positioning of the triggerbolt.

Accordingly, it is an object of the invention to provide a security lock with a triggerbolt which has an adjustable extension to accommodate different door gaps and which can be reversed in orientation to operate with strikeplates of different orientation.

The solenoid which operates a security lock typically has a high current coil to provide a momentary powerful thrust for moving a latchbolt or deadbolt against a biasing spring. After the bolt has changed its position, a second coil is connected to provide a low holding current which maintains the bolt in position. If the mechanism which switches the coils malfunctions, the solenoid may be continuously operated at a high current. The heat generated by the constant high current can damage the solenoid or create a serious fire hazard.

Accordingly, it is an object of the invention to provide a solenoid-actuated lock with a thermal protector which reduces the operational current of the solenoid when a dangerous heating condition is sensed. The thermal protector thus prevents undesirable heating while continuing to power the lock.

SUMMARY OF THE INVENTION

In order to achieve the objects of the invention and to overcome the problems of the prior art, the security lock of the invention includes a housing which slidingly supports either a deadbolt or a latchbolt. In operation, the bolt is extended outside the housing to lock the door with respect to a doorjamb and is retracted within the housing to unlock the door with respect to the jamb.

A deadlock lever is supported for pivotal movement within the housing between a locking position at which it blocks retracting movement of the bolt or an unlocking position at which it allows the bolt to be retracted within the housing to unlock the door. A release lever is pivotally connected to the deadlock lever to control the movement of the deadlock lever between its locking and unlocking positions.

A main operating lever is supported for pivotal movement within the housing and is connected at one end to the bolt and at its opposite end to the release lever. The operating lever pivots to control the extension and retraction of the bolt and the movement of the release lever.

A solenoid is connected to the operating lever to selectively pivot the lever and to thereby control the lock. In operation, the solenoid is selectively energized with a predefined maximum current and a predefined reduced current and is also de-energized to selectively control the pivotal movement of the operating lever.

A spring biases the end of the operating lever and thus defines a particular position of the bolt when the solenoid is de-energized. In one embodiment the spring is positioned so that the bolt is biased outwardly to lock the door when the solenoid is de-energized. In another embodiment the spring is placed to bias the operating lever in an opposite direction, so that the bolt is retracted within the housing of the lock when the solenoid is de-energized.

The operating lever of the invention is connected to its bolt through a lost motion connection which is dimensioned to allow bolts of different throw lengths to be used without requiring a change in the operational mechanism of the lock. Thus, the lost motion connection allows either a one-inch deadbolt or a three-quarter inch latchbolt to be reliably used.

The release lever has a holding apparatus which allows it to maintain the locked or unlocked position of the deadlock lever. The apparatus includes a pin which is affixed to the release lever and a spring which biases the pin at two positions. In the first position, the holding pin and release lever are biased to maintain the locked position of the deadlock lever. In the second position the spring biases the holding pin and release lever to maintain the unlocked position of the deadlock lever.

In a preferred embodiment of the invention, the solenoid has a primary coil, a secondary coil and a solenoid control switch which shunts the secondary coil to allow a maximum current to flow through the primary coil. The high current of the solenoid provides a powerful actuating force for moving the operating lever against its spring bias. When the operating lever has moved to a stationary position, the control switch connects the primary and secondary coils in series and thereby provides a reduced holding current which maintains the position of the operating lever against its spring bias.

The security lock of the invention further includes a thermal protector which connects the primary coil and secondary coil in series and thereby provides a reduced holding current for the solenoid when the temperature of the solenoid exceeds a predefined value.

The security lock of the invention also includes a triggerbolt which is slidingly supported within the housing of the lock and which is biased to extend outside the housing when the door is opened and is pressed into the housing when the door is closed. The triggerbolt includes a head portion which extends from the housing and retracts into the housing as the door is opened and closed. The head has a beveled front surface and a rear surface with a threaded opening. The triggerbolt also includes an end plate with a threaded hole and a shaft which connects the head and end plate. The shaft has a right-hand thread at the end which screws into the threaded opening of the head. The opposite end of the shaft has a left-hand thread which screws through the threaded hole of the end plate. The shaft is slidingly supported within the housing and carries a coil spring which biases the head outwardly from the housing.

The shaft is rotated to extend or retract the head of the triggerbolt with respect to the housing. The head can be rotated to change its position to accommodate strikeplates having different orientations.

The end plate of the triggerbolt engages the deadlock lever and biases the lever to its unlocked position when the triggerbolt is extended outside the housing. When the triggerbolt is pushed into the housing, the end plate disengages from the deadlock lever and thereby allows the lever to move to its locking position.

In the security lock of the invention, a frontplate slidingly supports the latchbolt or deadbolt and pivotally supports the operating lever. Screws secure the frontplate to the housing of the lock. The exposed heads of the screws are covered by a faceplate which is secured to the frontplate by tamper-resistant screws.

The lock of the invention can be monitored and operated from a remote guard station. In operation, a door position switch and either a deadlock lever switch or a bolt position switch are operated to illuminate indicator lights at the station to indicate the operational condition of the lock.

A local control switch had a local pushbutton may be provided adjacent to the lock to unlock the door if they are first activated from the remote guard station. A switch may also be provided to energize the solenoid of the lock in accordance with the position of the triggerbolt.

BRIEF DESCRIPTION OF THE DRAWINGS

FIG. 1A illustrates a perspective view in partial section of a doorjamb and a security lock in accordance with the invention.

FIG. 1B illustrates a perspective view in partial section of the strikeplate of a door which engages the lock of FIG. 1A.

FIG. 2 illustrates a cross-sectional view of the lock mechanism and door of FIGS. 1A and 1B, taken along a line 2—2.

FIG. 7 illustrates a perspective view in partial section of components which operate the latchbolt of the fail-secure lock of FIG. 5A.

FIG. 8 illustrates a cross-sectional view of the lock of FIG. 7, taken along a line 8—8.

FIG. 9 illustrates a cutaway view of a local key switch for the lock of FIG. 7.

FIG. 10A illustrates a side elevation view of components of a fail-secure lock in its unlocked position, with the door closed.

FIG. 10B illustrates a perspective view of a deadbolt which may be utilized with the lock of FIG. 10A.

FIG. 10C illustrates a partial sectional view of the deadbolt of FIG. 10B in the unlocked position shown for the latchbolt of FIG. 10A.

FIG. 11 illustrates a perspective sectional view of a solenoid control switch and an associated portion of the latchbolt of FIG. 10A.

FIG. 12 illustrates a perspective cutaway view of the deadlock lever and associated operating components for a fail-secure latchbolt lock with the door open and the solenoid of the lock de-energized.

FIG. 13 illustrates an exploded view of components of a release lever for the deadlock lever of FIG. 12.

FIG. 14A illustrates a cross-sectional view of the lock of FIG. 12, taken along a line **14*a*—14*a***.

FIG. 15 illustrates a cross-sectional view of the components of the triggerbolt, taken along a line 15—15 of FIG. 14A.

DETAILED DESCRIPTION OF PREFERRED EMBODIMENTS

Figure 4:
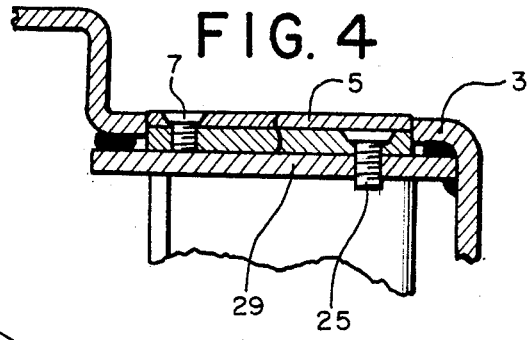
FIG. 4 is a cross-sectional view of a portion of the lock of FIG. 3, taken along a line 4—4.

The remaining portion of the specification will describe preferred embodiments of the invention when read in conjunction with the attached drawings, in which like reference characters designate identical apparatus.

FIG. 1A illustrates a perspective view in partial section of a mounted solenoid-actuated lock in accordance with the invention. As shown in FIG. 1A, the lock 1 is mounted within a doorjamb 3 formed by an upstanding metal rail. The lock 1 is mounted within the doorjamb 3 with a faceplate 5 extending outwardly. The lock is oriented within the jamb so that a triggerbolt 9 and latchbolt 11 extend outwardly. It should be appreciated that the lock of FIG. 1A can be mounted in other types of jambs. The jamb structure of FIG. 1A is thus shown for the purpose of discussion, without limiting the scope of the invention.

FIG. 1B illustrates a reinforced door 13 which carries a strikeplate 15 with an aperture 17 that is dimensioned to receive the latchbolt 11 in locking relation.

FIG. 2 illustrates a cross-sectional view of the doorjamb 3 in locked relation to the door 13 of FIG. 1B. As shown in FIG. 2, the jamb 3 is mounted to a wall 19 by anchoring hooks 21 which are embedded in the wall and which engage and press abutting surfaces of the jamb 3 against the wall. The lock 1 is mounted within an aperture 23 of the jamb by screws 25 which affix a flange portion of a frontplate 27 of the lock to a corresponding flange 29 which is affixed to the jamb 3, for example by welding. The faceplate 5 covers the screws 25 and is affixed to the plate 27 by tamper-resistant screws 7, as shown in FIG. 1A.

As shown in FIG. 2, the door 13 is affixed by a hinge 31 to a supporting wall, so that the door will swing outwardly to open a cell 14. When the door 13 is closed, a beveled surface 33 of the strikeplate 15 rides along an inclined surface 35 of the latchbolt 11 and thus presses the latchbolt 11 into the lock 1. The retracted latchbolt then slides along the surface of the strikeplate 15 until it enters the aperture 17.

An inclined edge of the triggerbolt 9 also engages the beveled edge 33 and is pressed into the lock as it slides along the strikeplate 15. However, there is no mating aperture in the strikeplate for the triggerbolt and the triggerbolt therefore remains pressed inwardly into the lock 1 while the door is closed.

As shown in FIG. 1A, a key cylinder 39 is affixed to the lock 1 to allow unlocking of the door from outside of the cell. In the embodiment of FIG. 1A, a guard's key 37 is rotated, for example in a counterclockwise direction, to mechanically retract the latch-bolt 11 and thus unlock the door. The lock may also be controlled electrically by using remote or local switches to energize and de-energize a solenoid 49 which controls the extension and retraction of the latchbolt 11.

In the following description of the lock of the invention, the terms "cell," "inmate" and "guard" are used to respectively describe the secured area, the person secured within the area and a person with authority to control access to the area. It should be understood that these terms are used for descriptive purposes and are not intended to limit the use of the lock. Thus, for example, the lock could be used in a hospital or other like institutional setting without departing from the spirit of the invention. The above-indicated descriptive terms will be used hereafter in their broadest sense to facilitate an understanding of the invention, without limiting the scope of application of the invention.

In a preferred system, a remote guard station monitors the operational condition of the lock 1 and may remotely unlock the door to allow an inmate to leave his cell. Alternatively, the inmate may press a local pushbutton 43 within his cell to unlock the door, if the guard station has previously activated the pushbutton to allow it to operate the lock. If the pushbutton 43 is deactivated at the remote guard station, the door will remain locked when the inmate presses the button 43.

An inmate's key 41 may be provided and keyed to the cylinder 39 for actuating movement only in the clockwise direction. The inmate enters his locked cell by turning his key 41 clockwise to actuate a local key switch (not shown in FIG. 1A) which operates the solenoid to unlock the door. As in the case of the pushbutton 43, the guard station must activate the local key switch before it will respond to the inmate's key 41.

If the guard's key 37 is turned clockwise, it will also actuate the locak key switch and will unlock the door if the remote guard station has activated the switch. As indicated above, the guard's key 37 can mechanically unlock the door and thus override all electrical systems. The mechanical operation of the lock will thus allow a guard to enter the cell quickly in an emergency situation. The cylinder 39 is constructed in a manner known to the art to turn in a counterclockwise direction only in response to the guard's key 37.

Although the door of FIG. 2 is shown opening outwardly with respect to the cell, it should be understood that the door may be hinged to open into the cell. If the door is mounted for inward-opening, the cylinder 39 and pushbutton 43 must be moved to opposite sides of the jamb 3, so that they can function as indicated above. If the lock 1 remains mounted in the position of FIG. 2, the cylinder 39 must have an extension (not shown) to reach the lock.

Figure 3:
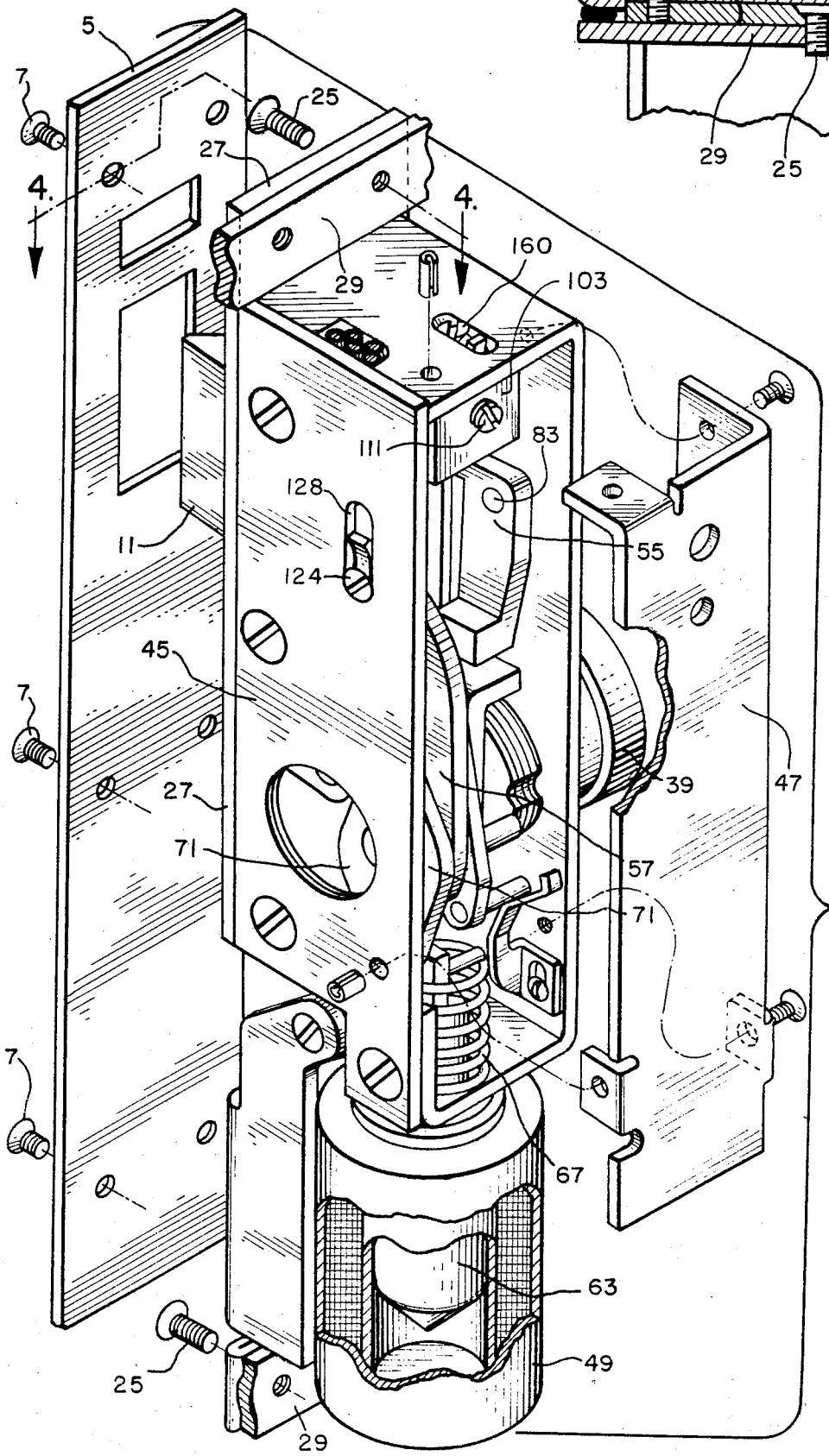
FIG. 3 illustrates an exploded view of the housing of the lock of FIG. 1A.

FIG. 3 illustrates an exploded perspective view of the lock of FIG. 1A. As shown in FIG. 3 and in the sectional view of FIG. 4, the internal mechanism of the lock is mounted within a housing that includes sidewalls 45, a backplate 47 and the front support plate 27. As explained previously, screws 25 affix the frontplate 27 to a flange 29 that is welded to the doorjamb. The faceplate 5 covers the screws 25 and is affixed to the frontplate 27 by tamper-resistant screws 7.

Figure 5A:
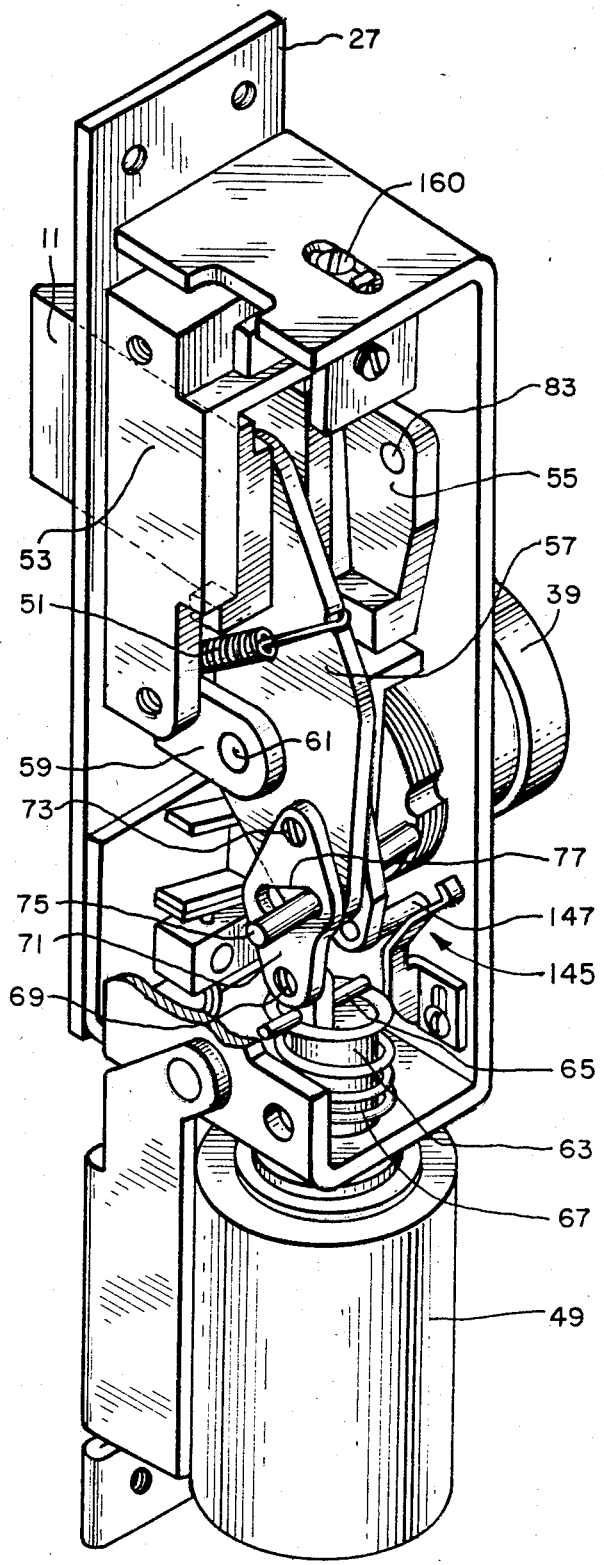
FIG. 5A illustrates a perspective view in partial section of a de-energized fail-secure lock with a latchbolt.

FIG. 5A illustrates a cutaway perspective view of an embodiment of a lock which operates in a "fail-secure" mode. That is, when the solenoid 49 is de-energized, a bias spring 51 holds the latchbolt 11 in an extended, locked position. Thus, the mechanism of FIG. 5A remains locked when the solenoid 49 is de-energized.

Figure 5B:
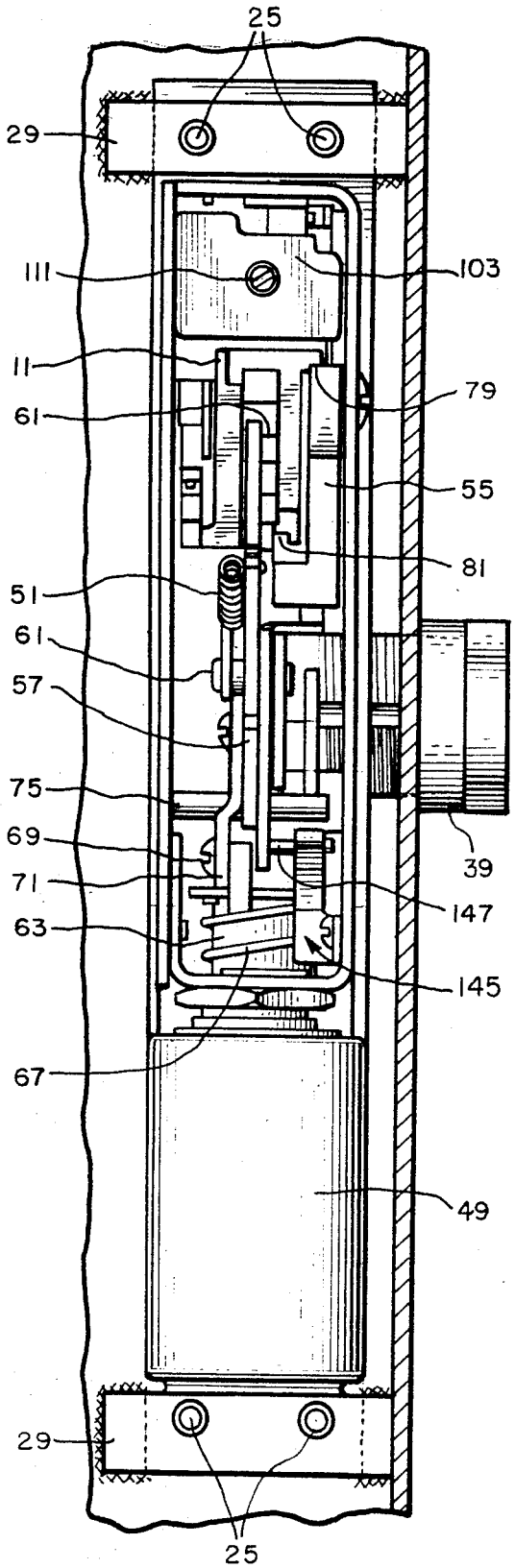
FIG. 5B illustrates a back elevation view of the lock of FIG. 5A.

FIG. 5B illustrates a back elevation view of the lock of FIG. 5A. As shown in FIGS. 5A, 5B and the exploded view of FIGS. 6A and 6B, the latchbolt 11 is carried for reciprocating, sliding movement within an aperture 85 of a support block 53 which is integrally formed on the front support plate 27. A deadlock lever 55 is pivotally supported behind the latchbolt 11 and is operated to block retracting movement of the latchbolt when the door is locked.

A main operating lever 57 is pivotally supported by a pin 93 with a knurled surface 95 which engages a support bracket 59 affixed to the frontplate 27. The operating lever 57 is pivotally connected with the latchbolt 11 by a pin 61 which is supported within a lost motion opening 87 of the latchbolt. A knurled surface of the pin 61 engages the operating lever in a mounting hole 89. Pivotal movement of the operating lever controls the extension and retraction of the latchbolt 11.

Figures 6A, 6B:
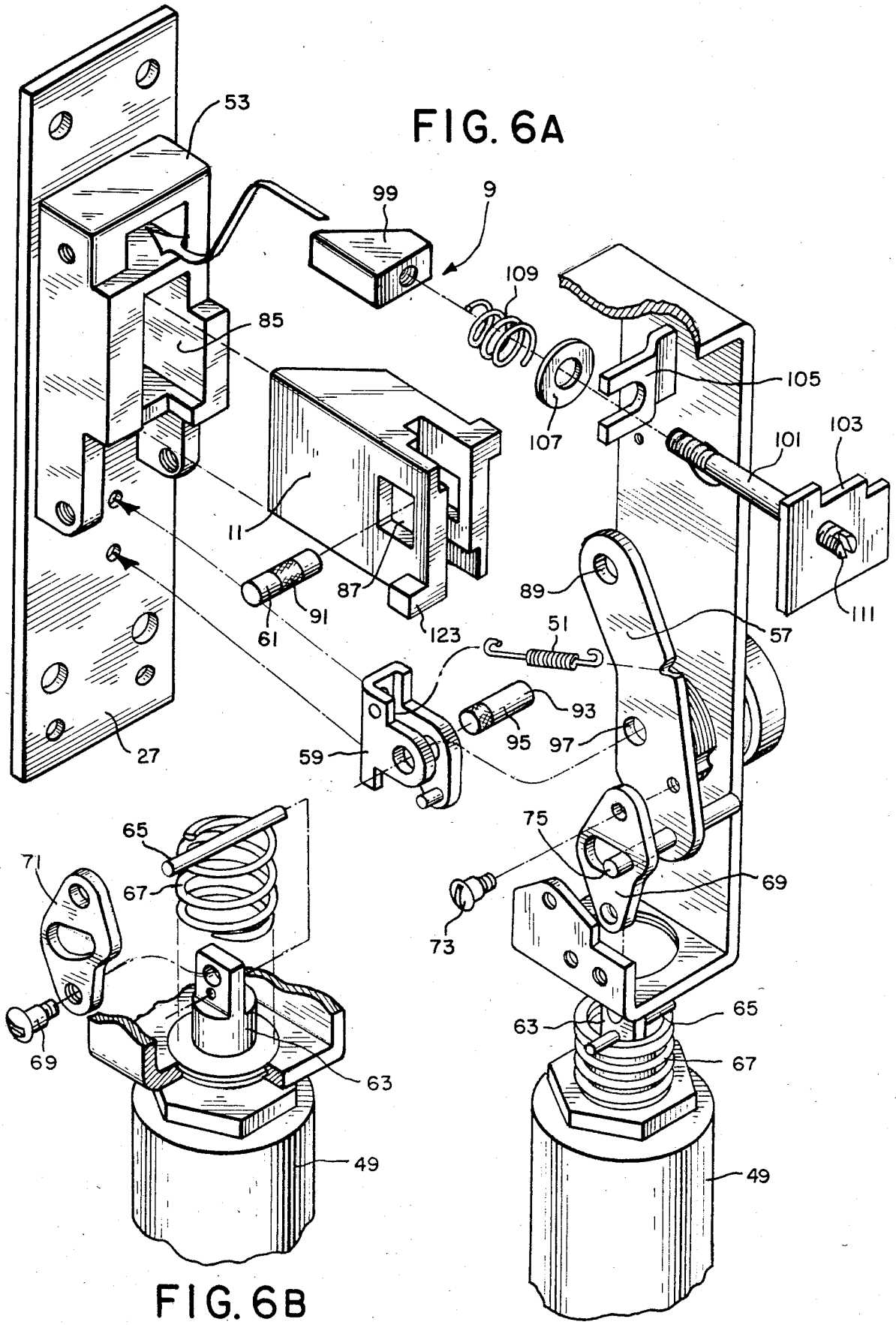
FIG. 6A illustrates an exploded view of some of the components of the fail-secure lock of FIG. 5A.
FIG. 6B illustrates an exploded view of the solenoid bias and link components of the lock of FIG. 5A.

As shown in FIG. 6A, the latchbolt is symetrically constructed so that it may be supported within the lock with its beveled surface in one of two orientations to accommodate different strikeplate orientations.

The solenoid 49 has an armature 63 which supports a pin 65 that abuts a compression spring 67. When the solenoid is de-energized, the spring 67 pushes upwardly on the pin 65 and thus causes the armature to fully extend from the solenoid. When the solenoid is energized, the armature is pulled into the body of the solenoid against the pressure of the spring 67. The solenoid 49 of FIG. 5A is de-energized and the armature 63 is therefore shown in its fully extended position.

The armature 63 is pivotally connected by a screw 69 to a link element 71. The link 71 is also pivotally connected by a screw 73 to the operating lever 57. A pin 75 is affixed to the operating lever 57 and passes through an opening 77 in the link 71.

When the solenoid 49 is de-energized, the armature 63 is fully extended and a bias spring 51 pulls down on the latchbolt end of the operating lever 57 to force the latchbolt 11 outwardly in a locked position. In FIGS. 5A and 5B, the triggerbolt is pushed inwardly to allow the deadlock lever 55 to move in locking relation to the backside of the latchbolt. Thus, as shown in FIG. 5B, the deadlock lever 55 engages the latchbolt at a top point 79 and a bottom point 81 on opposite sides of the lever's pivot point 83. The deadlock lever 55 is therefore held in a stable blocking position which ensures that the latchbolt remains fully extended in its locking position.

The components of the triggerbolt 9 are shown in the exploded view of FIG. 6A. As shown in FIG. 6A, the triggerbolt has a head portion 99, a shaft 101, a backplate 103 and a support bracket 105 which may be welded to the sidewall of the lock. The triggerbolt assembly also includes a washer 107 and a bias spring 109 which is shown with a reduced longitudinal dimension to facilitate illustration. Threads 111 at the back end of the shaft 101 are left-handed, so that the backplate 103 will move away from the bracket 105 when the shaft 101 is turned in a counterclockwise direction, for example by a screwdriver. The head 99 and adjacent end of the shaft 101 have a right-handed thread and are threadingly engaged in normal fashion. The head will therefore also move away from the bracket 105 when the shaft is turned counterclockwise. The shaft 101 may thus be turned counterclockwise to extend the head with respect to the housing and clockwise to retract the head. The triggerbolt assembly may therefore be adjusted to accommodate doors and jambs having a wide variety of gap dimensions.

The head 99 may be easily swiveled with respect to the the housing of the lock to position its beveled surface in proper alignment with strikeplates of different orientation.

FIG. 7 illustrates a perspective cutaway view of components of the fail-secure lock of FIG. 5A which control the movement of the latchbolt 11. FIG. 7 and the cross-sectional view of FIG. 8 show the orientation of the components when the latchbolt is fully extended in its locked position. FIG. 10A illustrates the orientation of the components when the latchbolt is retracted to unlock the door 13.

In operation, the guard's key 37 is turned counterclockwise in the cylinder 39 outside the cell to rotate a key cam 113 which engages the pin 75 of the operating lever 57. As the key 37 is rotated, the key cam 113 moves the pin 75 toward the frontplate 27 and pivots the operating lever so that the armature 63 is pushed into the solenoid and the latchbolt 11 is retracted to its unlocked position. Thus, as shown in the unlocked mechanism of FIG. 10A, the pin 75 and its associated end of the operating lever have moved adjacent to the frontplate 27 and the pin 61 at the opposite end of the operating lever has moved away from the frontplate 27 to pull the latchbolt 11 into the housing of the lock.

The above-described unlocking operation may also be achieved by energizing the solenoid 49 to pull the armature 63 into the solenoid and thus shift the components to the positions illustrated in FIG. 10A.

FIGS. 7, 8 and 9 illustrate an "inmate switch" 115 which is operated by clockwise movement of either the guard's key 37 or inmate's key 41. Clockwise movement of either key rotates the key cam 113 until it presses against a top bracket 117 of the switch 115. Further slight clockwise movement of the key cam 113 flexes the bracket 117 to operate the switch 115.

As shown in FIG. 7, a mounting wall 119 of the lock extends upwardly to provide a stop for the key cam 113. Thus, after the key cam 113 activates the switch 115, it abuts the end of the wall 119 and therefore cannot move further to damage the top bracket 117. The wall 119 thus acts to protect the bracket 117 against excessive deflection.

Although the fail-secure lock of the invention has been described in operation with a latchbolt, for example a three-quarter inch latchbolt, it should be understood that the lock may also operate with a deadbolt, for example a one inch deadbolt 88, as illustrated in FIG. 10B. The longer throw of the deadbolt of FIG. 10B makes it necessary to use a smaller width dimension for the lost motion opening 90 of the deadbolt in relation to the lost motion opening 87 of the shorter latchbolt. The different dimensioning of the openings provides a greater lost motion movement of the pin 61 and operating lever 57 for the latchbolt than for the deadbolt. The deadbolt may thus be fully retracted into the lock housing, as shown in the sectional view of FIG. 10C, and extended from the housing by the same mechanism which moves the latchbolt. Locks with bolts having different throw lengths can therefore be easily and relatively inexpensively assembled from essentially the same parts inventory.

FIG. 11 illustrates a partial perspective view of the latchbolt 11, operating lever 57 and an associated solenoid control switch 121 which operates the solenoid in accordance with the position of the latchbolt. As shown in FIG. 11, an extending ear 123 of the latchbolt flexes an operating arm 125 of the switch 121 when the latchbolt is retracted and releases the arm when the latchbolt is extended.

The switch 121 may be adjusted in position from outside the housing of the lock by a screw 124 which engages a support plate 126 of the switch through a slot 128. Thus, the position of the switch 121 may be occasionally adjusted to optimize operation, without dissembling the lock.

Figure 22:
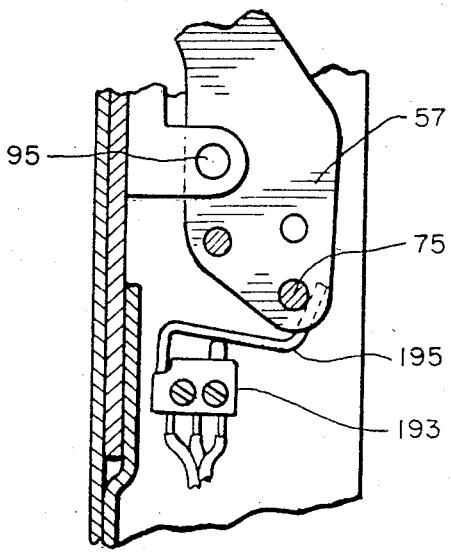
FIG. 22 illustrates a bolt position switch for a fail-safe latchbolt or deadbolt lock.

FIG. 22 illustrates a bolt position switch 193 which is controlled by the pin 75 of the operating lever 57. In operation, when the fail-secure lock is de-energized to extend the deadbolt, the pin 75 moves to the position shown in FIG. 22 and flexes an arm 195 to actuate the switch 193. When the solenoid is energized, the pin 75 disengages from the arm to release the switch 193. The pin 75 may also be moved by the key cam 113 of the cylinder 39 to mechanically unlock the door. Mechanical movement of the key cam operates the switch 193 in the manner described for the solenoid.

FIG. 12 is a cutaway perspective view of the deadbolt lever 55 and associated components of the fail-secure lock when the cell door is open and the solenoid is de-energized. As shown in FIG. 12, an operating arm 131 of the deadlock lever 55 is pressed toward the frontplate 27 by the backplate 103 of the triggerbolt mechanism when the triggerbolt is fully extended. The pressure of the backplate 103 on the arm 131 causes the back end 133 of the deadlock lever to pivot in spaced relation to the latchbolt 11. In this "released" deadlock lever position, the front point 79 and rear point 81 of the deadlock lever are spaced from the latchbolt 11, so that the latchbolt may freely move into and out of the housing of the lock.

The movement of the deadlock lever 55 is also controlled by a release lever 135 which has an extending tab 137 which engages a slot 138 at the back end 133 of the deadlock lever. The release lever 135 is pivotally connected by a screw to an extending support portion 139 of the support bracket 59. The pivotal movement of the release lever 135 is controlled by the pin 75 of the operating lever. In operation, the pin 75 engages a cam slot 141 of the release lever and rides along the slot to control the movement of the lever.

The interconnection between the release lever 135 and the deadlock lever 55 is adjusted by pivotal movement of a release lever arm 151 illustrated in the exploded view of FIG. 13. The arm 151 is pivotally affixed to an associated support portion 153 of the release lever by a screw 155. A position adjust screw 157 connects the opposite end of the arm 151 to the support 153 through an adjust slot 159. The arm 151 may therefore be pivotally moved by means of the slot 159 to achieve a proper interconnection between the release lever and the deadlock lever. When a proper adjustment is obtained, the adjust screw 157 is tightened to maintain the desired position of the arm 151 with respect to the support 153. The position of the arm 151 may occasionally be adjusted for optimum operation as the tab 137 of the arm or slot 141 wears in use.

As shown in FIGS. 12, 14A and the cross-sectional view of FIG. 15, a switch 161 is employed to indicate the position of the deadlock lever 55. As shown in FIG. 15, when the operating arm 131 of the deadlock lever is in the unlocked position of FIG. 14A, it flexes an arm 163 of the switch 161 and thus operates the switch. When the deadlock lever 55 pivots to its locked position, the operating arm 131 lifts to the position shown in hidden lines and thus releases the arm 163 of the switch 161.

The switch 161 is affixed to the housing by a screw 160 which may be used to adjust the position of the switch from outside the housing. The position of the switch may therefore be easily adjusted without dissembling the lock.

FIG. 14A illustrates a cross-sectional view of the apparatus of FIG. 12, taken along a line **14*a*—14*a*. The operating lever 57 is shown in phantom lines in FIG. 14A** to facilitate an understanding of the relative positions of the components when the fail-secure lock is de-energized and the door is open.

Figure 14D:
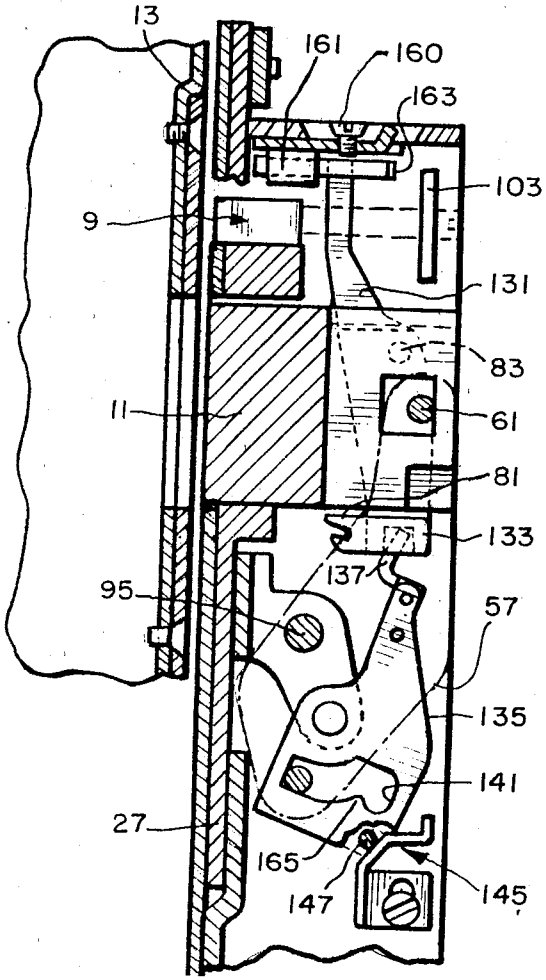
FIG. 14D illustrates a cross-sectional view of the deadlock lever components of the fail-secure lock of FIG. 14A, with the door closed and the latchbolt retracted.
Figure 14C:
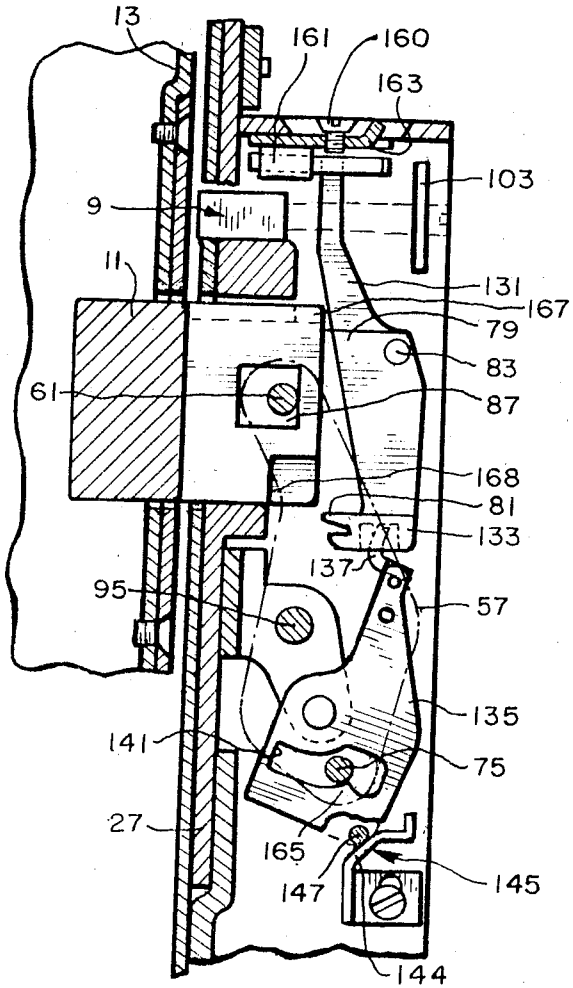
FIG. 14C illustrates a cross-sectional view of the deadlock lever components of the fail-secure lock of FIG. 14A, with the door closed and the deadlock lever retracted to its unlocked position.
Figure 14B:
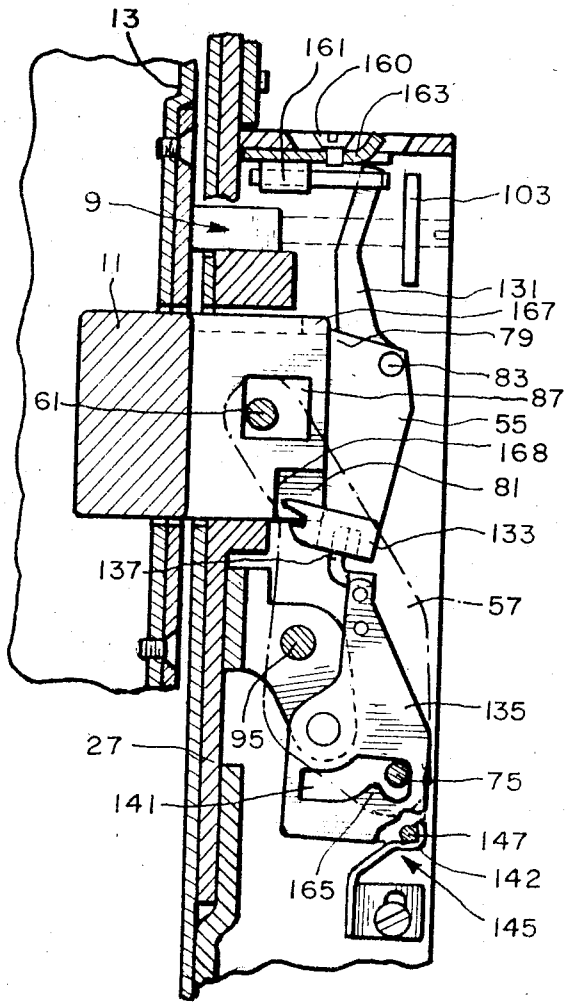
FIG. 14B illustrates a cross-sectional view of the deadlock lever components of the fail-secure lock of FIG. 14A, with the door closed and locked.

FIG. 14B shows the lock of FIG. 14A when the door 13 is closed. When the door is closed, the triggerbolt assembly 9 is pushed into the housing of the lock and the backplate 103 of the assembly is moved out of contact with the arm 131 of the deadlock lever 55. As shown in FIG. 14B, when the backplate 103 moves away from the arm 131, the deadlock lever pivots until its front point 79 contacts an ear 167 of the latchbolt and its rear point 81 contacts a locking edge 168 of the latchbolt. The points of contact are on opposite sides of the deadlock lever's pivot point 83 and therefore provide a stable deadlock for the latchbolt 11.

In the locked position of FIG. 14B, the pin 75 of the operating lever 57 rests at the indicated position in the slot 141 and a portion 142 of a spring 145 biases a pin 147 affixed to the release lever 135 to maintain the position of the lever 135. The force applied by the spring 145 holds the release lever 135 in the indicated position and thus ensures that the deadlock lever 55 remains in locked relation with respect to the latchbolt 11.

If the solenoid of the fail-secure lock is energized, or if the guard key 37 is turned counterclockwise in the cylinder 39, the mechanism of FIG. 14B will begin to unlock by initially moving the latchbolt pin 61 within its lost motion opening 87 and simultaneously lifting the deadlock lever 55 away from its locked position with respect to the latchbolt 11. The lost motion movement of the pin 61 allows the deadlock lever to move to its released position before the latchbolt 11 is retracted into the lock. The lost motion operation is essential to proper functioning of the lock, because it avoids undesirable interference of components as the lock is unlocked.

FIG. 14C illustrates an intermediate position of the lock when the deadlock lever 55 has pivoted to its released or unlocked position and the pin 61 has completed its lost motion movement. In moving to the position of FIG. 14C, the solenoid end of the operating lever 57 and its associated pin 75 move toward the frontplate 27. As the pin 75 moves toward the frontplate, it presses against a raised portion 165 of the slot 141 until it pivots the release lever 135 against the force of the spring 145, so that the tab 137 of the release lever moves away from the frontplate 27 and thus lifts the end 133 of the deadlock lever 55 away from the frontplate to its unlocked position. In the released or unlocked position of FIG. 14C, the deadlock lever is pivoted out of blocking alignment with the top ear 167 and locking ledge 168 of the latchbolt 11. The pivotal movement of the release lever 135 also slides the pin 147 along the spring 145 until an inclined portion 144 of the spring biases the pin to maintain the release lever and deadlock lever in the position of FIG. 14C.

Continued energization of the solenoid or turning of the key 37 further pivots the operating lever to the unlocked position illustrated in FIG. 14D. As the operating lever pivots to the position of FIG. 14D, it pulls the latchbolt 11 into the housing and unlocks the door 13.

Figure 16:
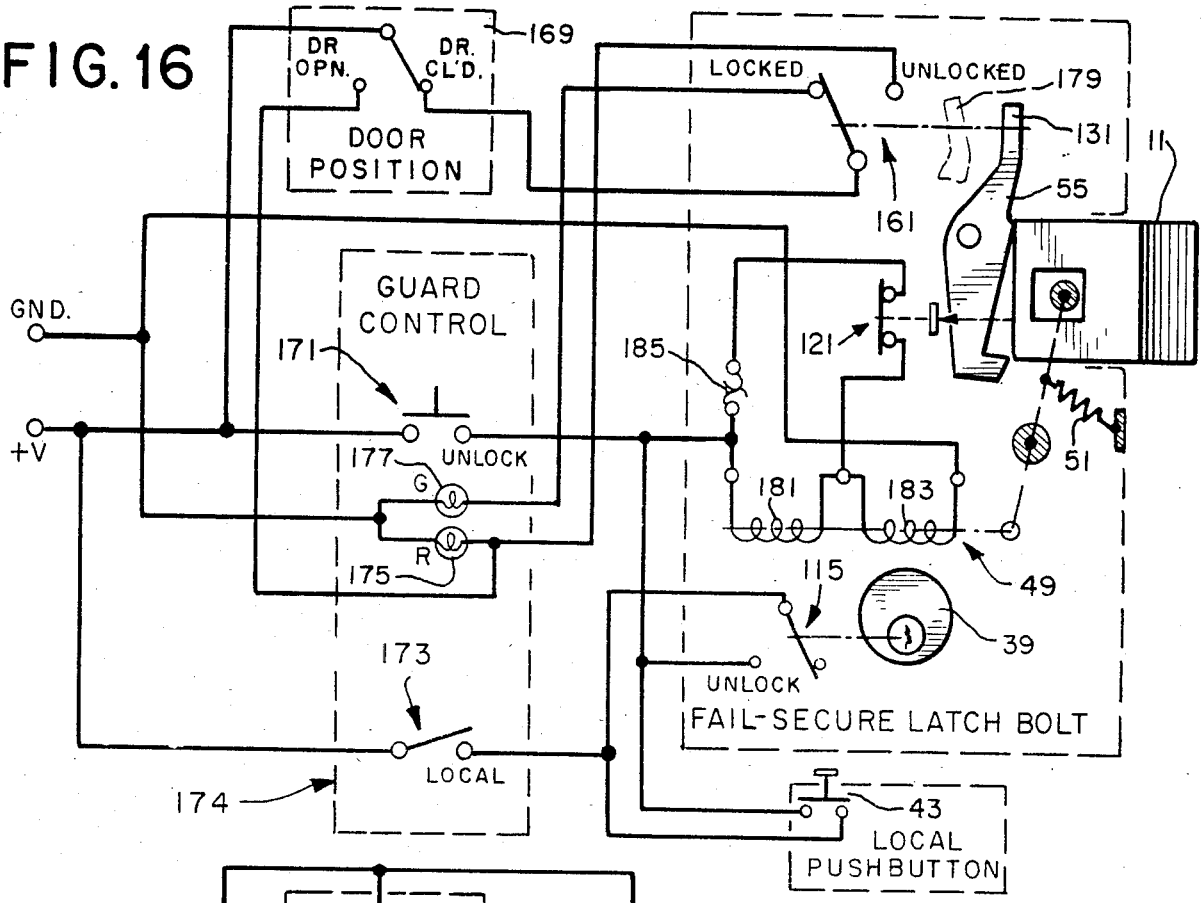
FIG. 16 illustrates a circuit diagram for the fail-secure latchbolt lock of FIG. 1A.

FIG. 16 illustrates a circuit diagram of switch connections for operating the fail-secure latchbolt lock of FIG. 1A. As previously discussed, the circuit includes a switch 161 which is operated by the arm 131 of the deadlock lever 55, shown in solid lines in its unlocked position. The switch 121 of FIG. 11 is provided to control the energization of coils 181 and 183 of the solenoid 49 in accordance with the position of the latchbolt 11.

The local key switch 115 (FIGS. 7–9) and pushbutton 43 (FIG. 2) are provided to electrically unlock the cell if they are activated by a local enable switch 173 at a guard control station 174. In a preferred embodiment of the invention, a door position switch 169 located at the hinge 31 of FIG. 2 indicates the position of the door. A guard control switch 171 at the control station is provided to selectively unlock the door.

A red indicator light 175 and a green indicator light 177 are provided to indicate the positioning of the door and the locked or unlocked positioning of the deadlock lever. In operation, switches 161 and 169 illuminate the red light when the door is open or when the door is closed and the deadlock lever 55 is in its unlocked position. The switches also operate to illuminate the green light when the door is closed and the deadlock lever 55 is in its locked position.

When the door is closed and locked, the solenoid control switch 121 is closed, as illustrated in FIG. 16, to provide a current shunt around the secondary coil 181 of the solenoid. Thus, when the solenoid is energized, for example by pushing the remote switch 171 at the guard station, current is shunted around the secondary coil 181 and is applied to the primary coil 183. In the system of the invention, the primary coil has substantially less resistance than the the secondary coil and therefore allows a relatively large current to flow when power is initially applied from the DC power supply +V. The initial surge of relatively large current provides a powerful pull on the latchbolt 11 to draw the latchbolt into the lock and thereby unlock the door. When the latchbolt 11 fully retracts into the door, it opens the switch 121 and thus removes the shunt and connects the primary and secondary coils in series. The higher resistance of the series connected coils results in a reduced current which provides a lesser holding force to maintain the latchbolt in its unlocked position. The lower holding current of the solenoid reduces power consumption and also reduces heating of the solenoid during its normal holding operational state.

If the switch 121 malfunctions or if the latchbolt sticks in a partially retracted position, a high current will be continuously applied to the solenoid. If the high current is maintained, the solenoid could be damaged as a result of excessive heating.

The solenoid is protected by a thermal protector 185 which opens the shunt circuit to reduce the operational current in response to excessive heating of the solenoid. When the temperature drops to a safe level, the thermal protector closes the shunt circuit and again applys a relatively high current to the solenoid. The surge of high current provides a powerful pull on the latchbolt which could jar the latchbolt to its fully retracted position and thus correct the malfunction.

In a preferred embodiment of the invention, a commercially available KLIXON thermal protector (Model No. 9700K36-33) manufactured by Texas Instruments may be used. However, other types of thermal protectors can be used, without departing from the invention.

In a preferred embodiment of the invention, the solenoid circuit dissipates approximately 85 watts during high current operation and 6 watts during low current operation. The circuit of FIG. 16 is designed to operate with approximately 24 volts and, accordingly, the desired operational characteristics of the solenoid are achieved by providing a primary coil of about 7 ohms and a secondary coil of about 90 ohms. It should be appreciated that other voltages or values of resistance can be used, without departing from the spirit of the invention. Moreover, although the circuit of FIG. 16 illustrates a DC power supply, alternating current can be used if a rectifier is added to provide DC power for the solenoid 49.

Figure 17:
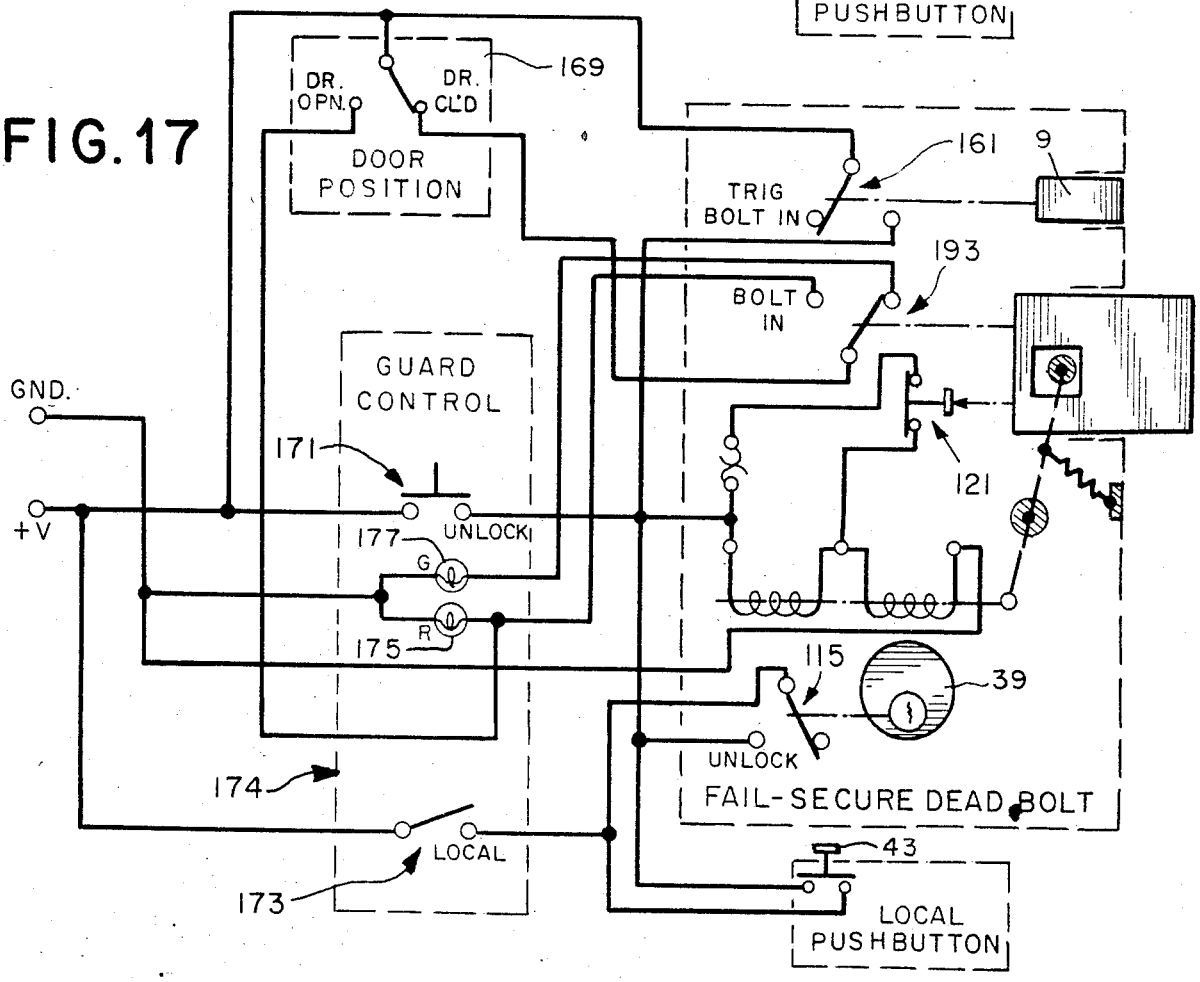
FIG. 17 illustrates a circuit diagram for the fail-secure deadbolt lock of FIG. 10C.

FIG. 17 illustrates a circuit diagram for operating a fail-secure lock with a deadbolt, for example as shown in FIG. 10C. If a deadbolt is used in the fail-secure lock, a different method must be employed for actuating the switch 121 which controls the application of power to the solenoid coils.

Figure 21:
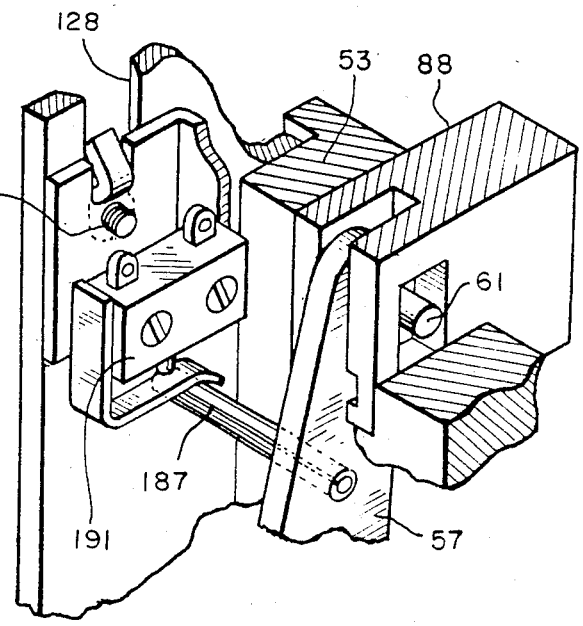
FIG. 21 illustrates a partial cutaway perspective view of the solenoid control switch and associated operating mechanism for a deadbolt lock.

FIG. 21 illustrates the operation of a solenoid control switch in association with a deadbolt. As shown in FIG. 21, a pin 187 is carried by the operating lever 57 to actuate the adjacent switch and thereby indicate the position of the deadbolt. The pin 187 must be employed to operate the switch because the deadbolt does not have an extending ear, such as the ear 123 of FIG. 11, to operate the switch. The ear 123 is removed in order to provide an increased extension for the deadbolt.

It should now be appreciated that, while the solenoid control switch of FIG. 17 is indicated as 121, the switch 121 of FIG. 17 must be reversed in position with respect to the switch 121 of FIG. 16. The reversal of position is required to operate the switch 121 with the pin 187 of the deadbolt. The electrical operation of the switch 121 of FIG. 17 is the same as the electrical operation of the switch 121 of FIG. 16.

In FIG. 17 the triggerbolt 9 operates the switch 161, rather than the arm 131 of the deadlock lever 55. Thus, the switch 161 is operated in one direction if the triggerbolt is retracted into the lock when the door is closed and is operated in an opposite direction when the door is open and the triggerbolt is extended. The backplate 103 of the triggerbolt is used to flex the operating arm of the switch 161 to indicate the position of the triggerbolt.

The switch 161 of FIG. 17 controls the operation of the solenoid. Thus, if the triggerbolt is extended when the door is open, the solenoid is energized to retract the deadbolt. When the door is closed, the triggerbolt is pressed into the lock and the switch 161 is operated to lock the door by de-energizing the solenoid.

The circuit of FIG. 17 includes the additional switch 127 of FIG. 12 to indicate the position of the deadbolt. The switch 127 and the door position switch 169 are employed to illuminate the green light 177 if the door is closed and locked and to illuminate the red light if the deadbolt is retracted or the door is open. The local switch 173, control switch 171, local pushbutton 43 and local key switch 115 operate in the manner described for the circuit of FIG. 16.

Figure 18:
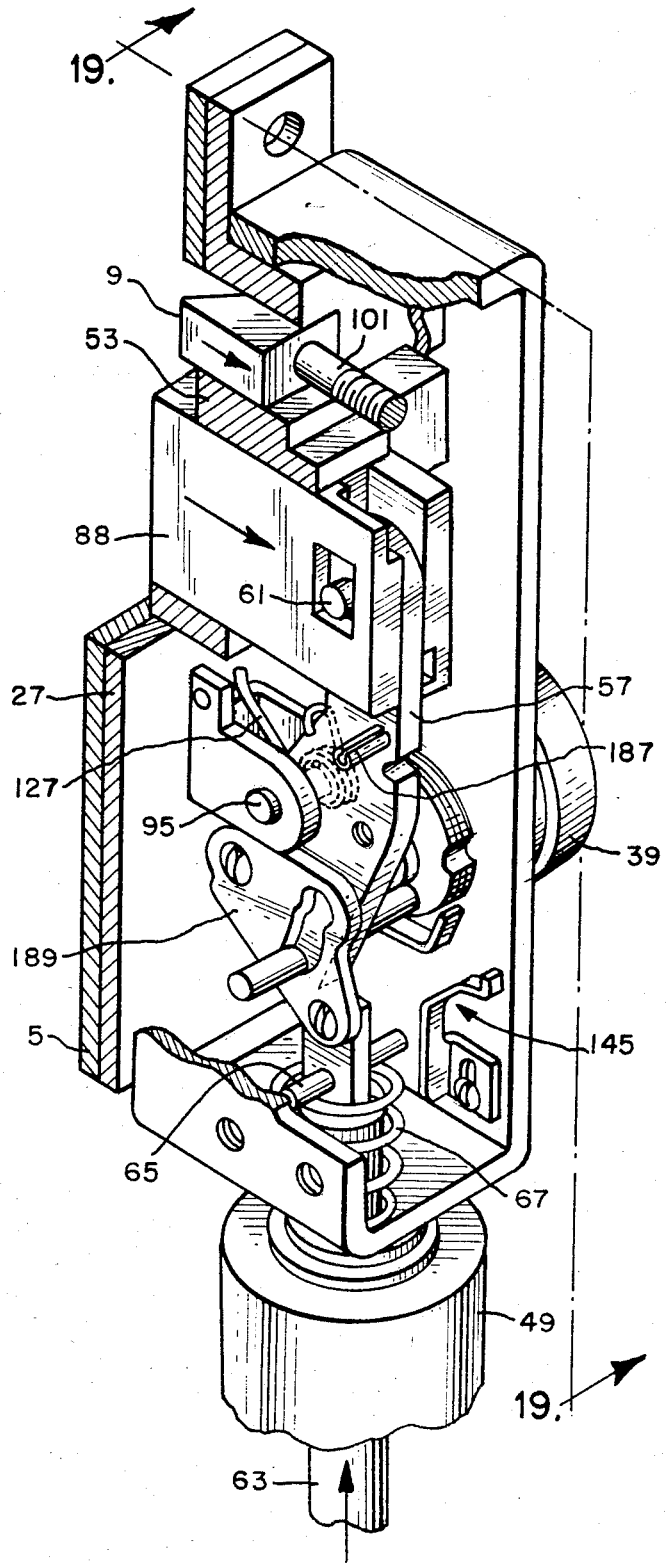
FIG. 18 illustrates a cutaway perspective view of an unlocked fail-safe deadbolt lock.

FIG. 18 illustrates a perspective view in partial section of a fail-safe deadbolt lock with the solenoid 49 de-energized. The fail-safe deadbolt lock uses a spring 127 to bias the deadbolt end of the operating lever away from the frontplate 27 in order to pull the deadbolt into the housing of the lock when the solenoid is de-energized. Thus, the operation of the spring 187 is different than the operation of the spring 51 of the fail-secure lock of FIG. 5A.

The fail-safe lock also uses a link 189 which is connected to the operating lever 57 at a point spaced from the point of connection of the link 71 of the fail-secure lock. Aside from the link elements 71 and 189, springs 51 and 187 and a few switches, the fail-secure and fail-safe locks use the same components. Thus, locks with different operational modes can be easily constructed from essentially the same parts inventory and lock functions can be relatively easily changed by changing only a few components.

The lock of FIG. 18 is showm with a deadbolt 88 to further illustrate the interchargeability of deadbolts and latchbolts in the apparatus of the invention. Thus, a latchbolt can be used with the fail-safe lock of FIG. 18, without departing from the invention. The latchbolt and deadbolt are interchangeable in the lock of FIG. 18 in the same manner as was described for the fail-secure lock, with respect to FIGS. 10A and 10C.

Figure 19:
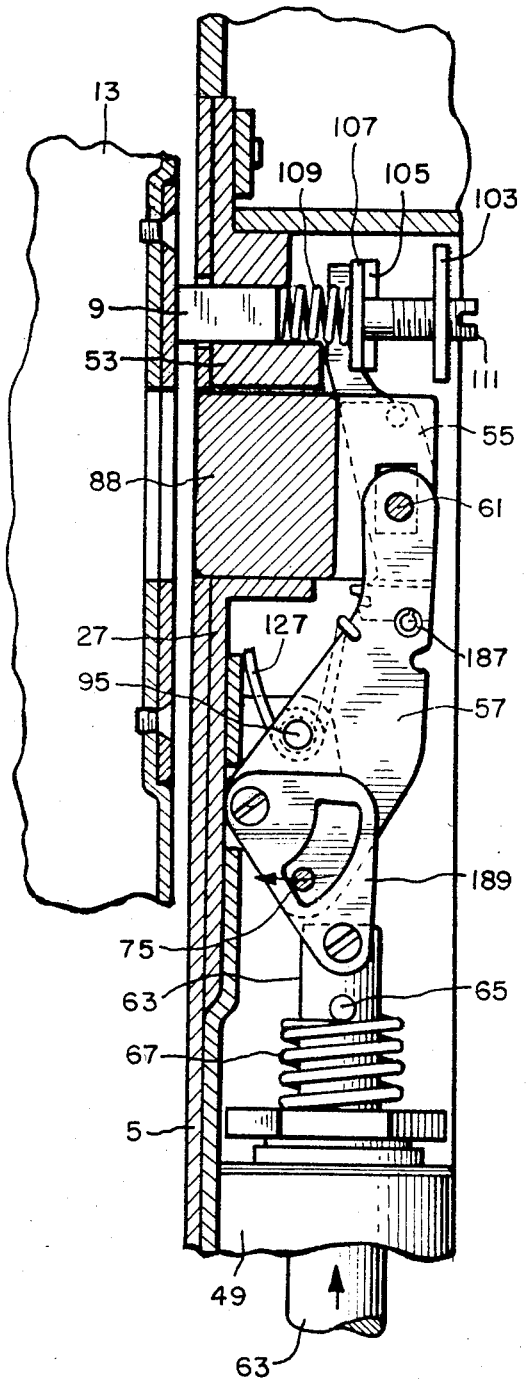
FIG. 19 illustrates a cross-sectional view of the lock of FIG. 18, taken along a line 19—19.

FIG. 19 is a cross-sectional view of the fail-safe lock of FIG. 18, taken along a line 19—19. FIG. 19 illustrates the positions of several of the operational components of the lock when the door 13 is closed, the solenoid is de-energized and the lock is unlocked. As shown in FIG. 19, in the unlocked position the armature 63 of the solenoid is fully extended in response to the pressure of the compression spring 67 against the pin 65. The pin 75 of the operating lever is adjacent to the frontplate 27 when the lock is unlocked.

Figure 20:
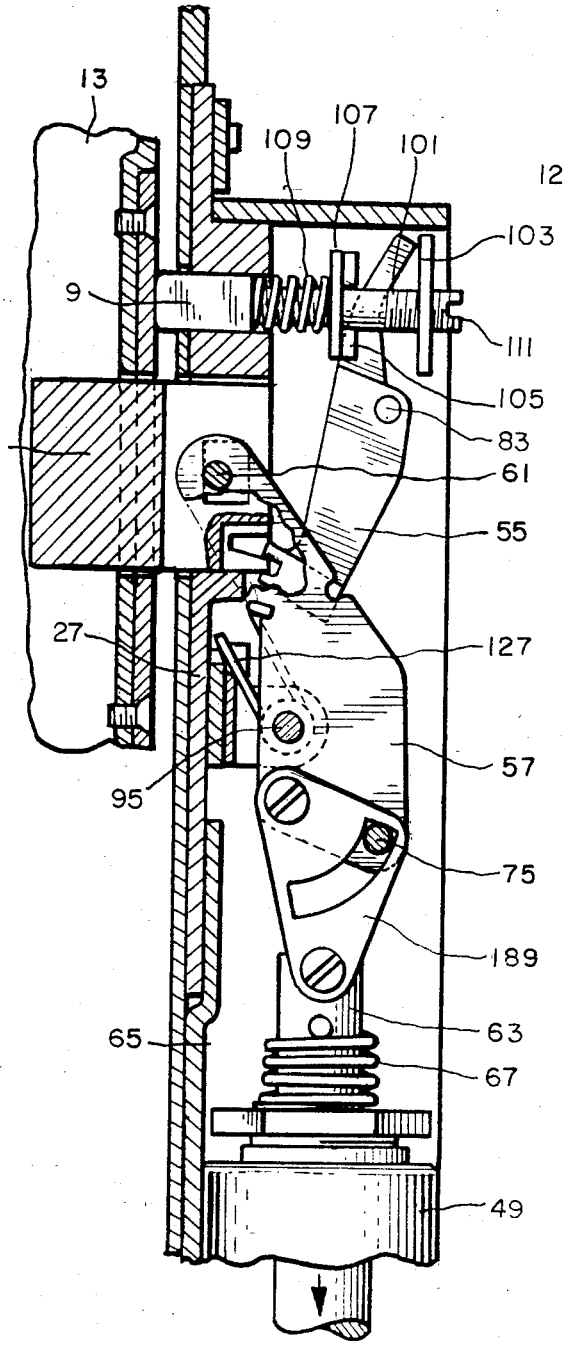
FIG. 20 illustrates a cross-sectional view of the fail-safe deadbolt lock of FIG. 19, with the deadbolt in its locked position and the deadlock lever in its locked position.

FIG. 20 illustrates the apparatus of FIG. 19 when the solenoid is energized to retract the armature 63. When the armature 63 is retracted, the pin 61 of the operating lever is moved toward the frontplate 27 to extend the deadbolt 88. FIG. 20 illustrates the locked position of the components of the lock.

As explained previously, FIG. 21 illustrates the positioning of a solenoid control switch 191 for actuation by a pin 187 which is affixed to the operating lever 57.

FIG. 22 illustrates the bolt position switch 193 which is controlled by the pin 75 of the operating lever 57. In operation, when the fail-safe lock is energized to extend the deadbolt, the pin 75 moves to the position shown in FIG. 22 and flexes an arm 195 to actuate the switch 193. When the solenoid is de-energized, the pin 75 disengages from the arm 195 to release the switch 193.

The operation of the fail-safe lock has heretofore been described with respect to energization and de-energization of the solenoid 49. However, it should be understood that the fail-safe lock may be mechanically unlocked by counterclockwise rotation of a guard key 37 to push the pin 75 toward the frontplate 27 and to thus pivot the operating lever and retract the deadbolt. The keying of the cylinder 39 and operation of the keys 37,41 for the fail-safe lock is the same as was described for the fail-secure lock.

Figure 23C:
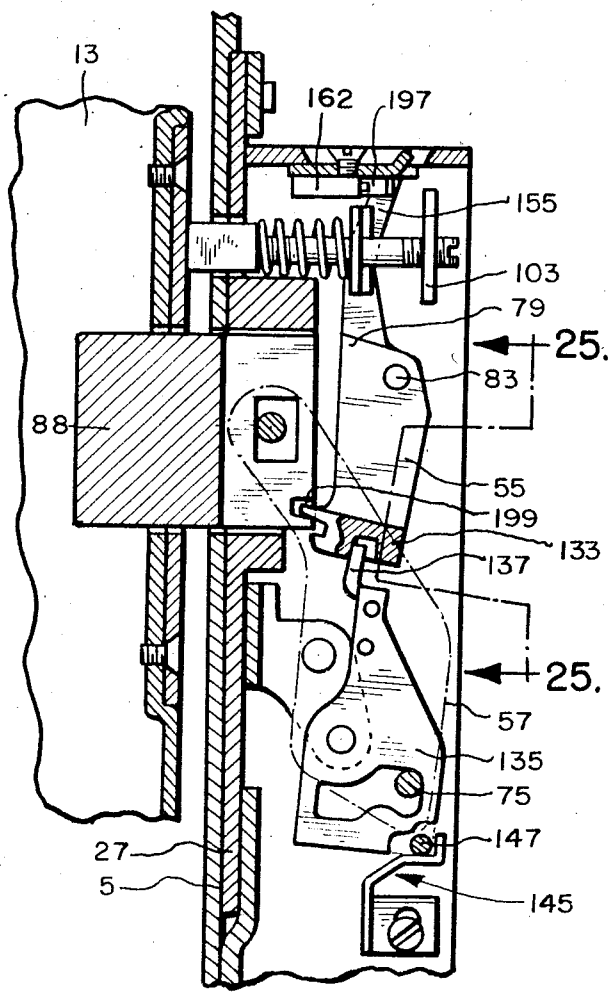
FIG. 23C illustrates a cross-sectional view of the fail-safe lock of FIG. 23A, with the door closed and locked.
Figure 23B:
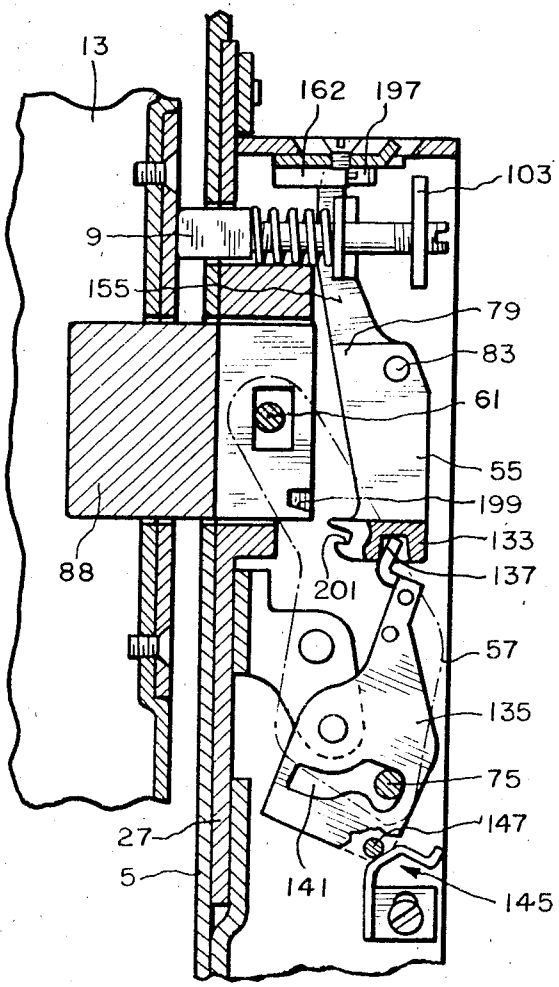
FIG. 23B illustrates a cross-sectional view of the fail-safe lock of FIG. 23A, with the door closed, deadbolt extended and deadlock lever at its unlocked position.
Figure 23A:
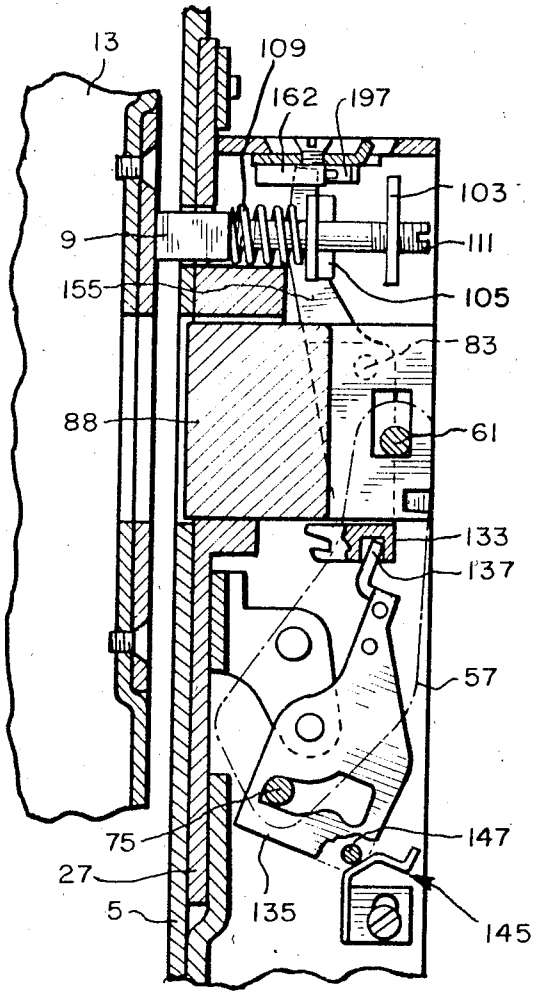
FIG. 23A illustrates a cross-sectional view of a fail-safe deadbolt lock with the door closed and unlocked.

FIG. 23A illustrates a cross-sectional view of the deadlock lever of the fail-safe lock of FIG. 18 in association with its actuating components. The lock of FIG. 23A is shown with the door 13 closed and the deadbolt 88 retracted. In the position shown in FIG. 23A, the spring 145 presses on the pin 147 of the release lever 135 to maintain the deadlock lever 55 in its released position.

A triggerbolt position switch 162 is oriented to operate with the backplate 103 of the triggerbolt assembly. In operation, the backplate 103 flexes an operating arm 197 of the switch to activate the switch when the door is open and and triggerbolt is fully extended. In the position shown in FIG. 23A, the triggerbolt 9 is pressed into the lock housing and the operating arm 197 of the switch 162 is therefore released by the backplate 103.

In the position shown in FIG. 23A, the solenoid of the fail-safe lock is de-energized and the pin 75 of the operating lever is therefore at its closest position with respect to the frontplate 27.

FIG. 23B illustrates the fail-safe lock of FIG. 23A when the solenoid is initially energized, for example by a switch at a remote guard station. Initial energization of the solenoid causes the operating lever to pivot so that the deadbolt 88 is extended into the strikeplate aperture of the door 13. Thus, the pin 61 of the operating lever moves toward the frontplate 27 to extend the deadbolt and the opposite pin 75 of the operating lever moves away from the frontplate within the slot 141 of the release lever 135. The deadlock lever 55 and release lever 135 are maintained in the positions shown in FIG. 23A by the bias force of the spring 145 against the pin 147.

FIG. 23C illustrates the final locking movement of the components of the lock when the deadbolt 88 is fully extended into the door 13. As shown in FIG. 23C, the pin 75 of the operating lever lifts the end of the release lever opposite the tab 137 away from the frontplate 27 and thus forces the tab down toward the frontplate. The back end 133 of the deadlock lever is therefore pivoted into locking engagement with the deadbolt 88. The release lever 135 is maintained in the position of FIG. 23C by the pressure of the spring 145 against the pin 147.

As explained previously, and as illustrated in FIG. 10B, the deadbolt 88 does not have the extending ears 123,167 which are provided for the latchbolt. Accordingly, the forward point 79 of the deadlock lever 55 cannot engage the back of the deadbolt 88. The deadlock lever 55 can therefore only engage the deadbolt 88 at one point.

The locking engagement of the lever 55 and deadbolt 88 is achieved when an edge or lip 199 at the back end of the deadbolt 88 is engaged within a corresponding slot 201 formed at the back end 133 of the deadlock lever. This interlocking engagement is required in order to ensure that the deadlock lever remains in locked relation to the deadbolt.

Figure 24:
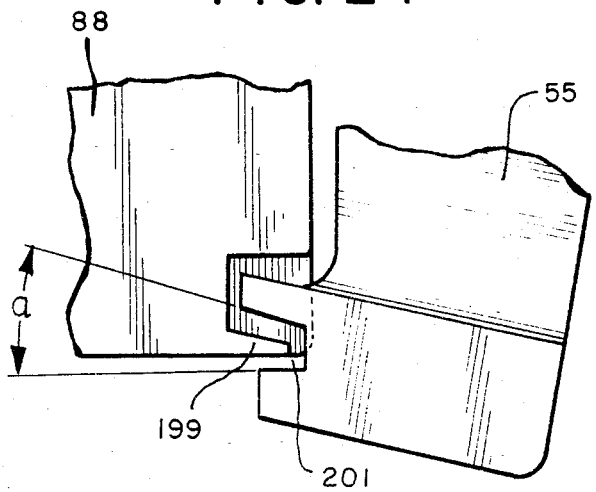
FIG. 24 illustrates a magnified partial side elevation view of the deadlock lever engaged with its deadbolt.

Binding of the deadbolt and the deadlock lever in the locked position must be avoided, particularly in the event that an inmate leans on the door at the time that the lock is being unlocked. As shown in FIG. 24, binding is avoided by shaping the lip 199 and slot 201 with matching angular surfaces formed at an angle "a" of, for example, 16°. Thus, even if an inmate applys pressure to the door when the lock is being unlocked, the angular surface of the deadlock lever 55 can still be relatively easily slipped out of engagement with the matching angular surface of the lip 199 of the deadbolt 88.

Figure 25:
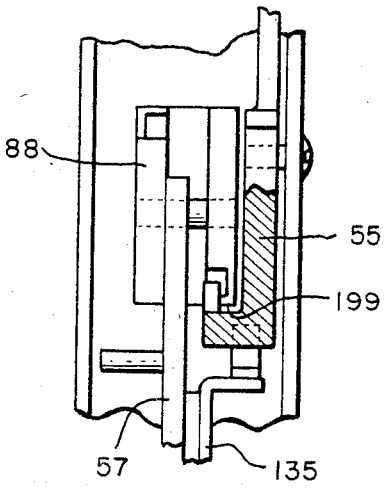
FIG. 25 illustrates a partial cross-sectional back view of the deadlock lever engaged with its deadbolt.

FIG. 25 illustrates a sectional back view of the deadlock lever 55 in engaged relation with the deadbolt. It should be particularly noted that the deadlock lever engages the deadbolt only at the lip 199, so that the lip 199 provides the only frictional engagement between the two pieces. The reduced area of frictional engagement is necessary in order to ensure that the deadlock lever and deadbolt can be reliably disengaged.

Figure 26:
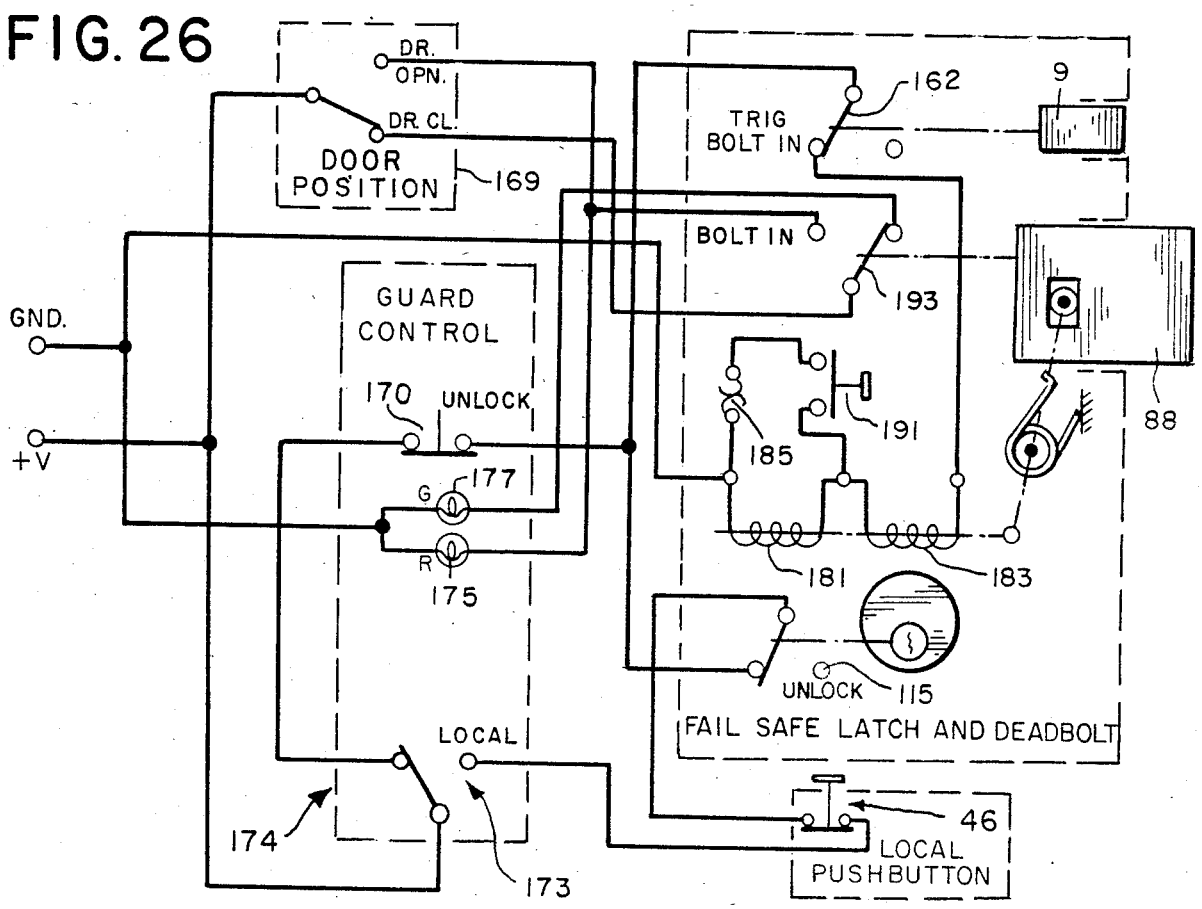
FIG. 26 illustrates a circuit diagram of the control circuit for a fail-safe latchbolt or deadbolt lock.

FIG. 26 illustrates a circuit diagram of switches and switch connections which may be used to operate the fail-safe lock of the invention, with either a latchbolt or a deadbolt. The switch 162 is operated by the backplate 103 of the triggerbolt 9, as described for FIGS. 23A–C. The bolt position switch 193 of FIG. 22 is provided to indicate the operational position of the deadbolt 88. The switch 191 of FIG. 21 is provided to control the energization of the primary coil 183 and secondary coil 181 of the solenoid and local switches 46 and 115 are provided to unlock the fail-safe lock of FIG. 26. The local control switch 173 is provided to activate the local switches 46 and 115 and the control switch 170 is provided to unlock the lock. The indicator lights 175 and 177 and the door position switch 169 are operated to provide the functions discussed with respect to FIGS. 16 and 17.

The circuit of FIG. 26 differs from the circuits of FIGS. 16 and 17 in that it must continuously energize the solenoid to hold the deadbolt 88 in its locked position. Thus, the local pushbutton switch 46 and local key switch 115 are connected to de-energize the solenoid if the local control switch 173 at the guard station 174 is moved to its local position.

The solenoid control switch 191 of FIG. 26 operates to provide a constant relatively low current through the coils 181 and 183 of the solenoid for as long as the deadbolt 88 is extended to lock the door. However, when the solenoid is de-energized, the deadbolt 88 retracts and operates the switch 191 to provide a shunt around the coil 181. When the solenoid is energized thereafter to lock the door, a relatively high current initially flows through the shunt formed by the switch 191 and through the primary coil 183. The relatively high current causes the deadbolt 88 to be forcefully pushed to its extended, locked position. When the deadbolt 88 is in its extended position, the switch 191 is opened to remove the shunt and the secondary coil 181 is therefore connected in series with the primary coil 183 to provide a reduced operating current for the solenoid.

The thermal protector 185 operates in the manner described with respect to FIGS. 16 and 17 to provide a reduced operational current for the solenoid whenever a dangerously high temperature is detected.

The fail-safe and fail-secure latchbolt and deadbolt embodiments for the lock of the invention have been described in some detail to facilitate an understanding of the invention. However, it should be appreciated that the invention is not limited by this particular description. The invention may be embodied in other specific forms without departing from its spirit or essential characteristics. The present embodiments are, therefore, to be considered in all respects as illustrative and not restrictive. The scope of the invention is indicated by the claims rather than by the foregoing description and, accordingly, all changes which come within the meaning and range of the equivalents of the claims are intended to be embraced therein.

I claim:

1. A security lock for locking and unlocking a door with respect to a doorjamb, comprising:

a housing;

bolt means slidingly supported within said housing for extending outside the housing to lock said door with respect to said jamb and for retracting within said housing to unlock the door and jamb; and deadlocking means pivotally supported at a pivot point for movement between a locking position for blocking retracting movement of the bolt means to lock the door and an unlocking position for allowing the bolt means to be retracted within the housing to unlock the door, the deadlocking means including a front blocking portion and a rear blocking portion positioned on opposite sides of said pivot point, said front and rear blocking portions having means for jointly blocking retracting movement of said bolt means.

2. The security lock of claim 1, wherein said bolt means includes a latchbolt having a free end for extending to lock the door and having a beveled portion tapering to a point at said free end.

3. The security lock of claim 1, wherein said bolt means includes a deadbolt having a free end for extending to lock the door, the free end having a flat face.

4. The security lock of claim 1, further including release lever means for controlling the pivotal movement of said deadlocking means.

5. The security lock of claim 4, including means for biasing the release lever means to maintain the locking position of said deadlocking means and the unlocking position of the deadlocking means in spaced relation to said bolt means.

6. The security lock of claim 4, including pivotally mounted operating lever means;

lost motion means for connecting one end of said operating lever means to said bolt means in a lost motion relation;

means for slidingly connecting an opposite end of said operating lever means to said release lever means for controlling the movement of the release lever means in response to pivotal movement of the operating lever means; and means for selectively pivotally moving said operating lever means to control the extension and retraction of said bolt means and the corresponding pivotal locking and unlocking movement of said deadlocking means, so that said deadlocking means moves to its locking position to block retraction of the bolt means after the bolt means is fully extended and moves to its unlocking position to allow retraction of the bolt means immediately prior to the beginning of retracting movement of the bolt means.

7. The security lock of claim 6, wherein said means for selectively pivotally moving includes a solenoid for selectively controlling the pivotal movement of said operating lever means in response to electrical control signals.

8. The security lock of claim 6, wherein said lost motion means includes pin means affixed to said operating lever means, and an aperture extending through said bolt means for receiving said pin means, the aperture dimensioned to allow the pin means to move longitudinally with respect to the bolt means.

9. The security lock of claim 8, wherein the longitudinal dimension of said aperture is inversely related to the throw length of said bolt means.

10. The security lock of claim 1, wherein said bolt means includes a deadbolt having a free end for extending to lock the door and a rear end for engaging said deadlocking means at only said rear blocking portion to block retracting movement of the deadbolt, the rear end of the deadbolt including a lip and the rear blocking portion including a mating slot for engaging the lip to block retracting movement of the deadbolt when the door is locked.

11. The security lock of claim 10, wherein said lip and slot are angled to facilitate disengagement of said deadlocking means and said deadbolt.

12. The security lock of claim 1, wherein said bolt means includes a latchbolt having a free end for extending to lock the door and a rear end with means for engaging said deadlocking means at said front and rear blocking portions to block retracting movement of the latchbolt.

13. The security lock of claim 12, wherein said means for engaging includes an ear portion formed on said latchbolt for contacting the front blocking portion of the deadlocking means when the deadlocking means is in its locking position.

14. The security lock of claim 1, wherein said front and rear blocking portions of said deadlocking means jointly block retraction of a bolt means having a particular throw length and said rear blocking portion by itself blocks retraction of a bolt means having a throw length greater than said particular throw length.

15. The security lock of claim 14, wherein the bolt means having a particular throw length is a latchbolt with a three-quarter inch (1.905 cm) throw length and the bolt means of greater throw length is a deadbolt with a one inch (2.54 cm) throw length.

16. A security lock for locking and unlocking a door with respect to a doorjamb, comprising:

a housing;

bolt means slidingly supported within said housing for extending outside said housing to lock said door with respect to said jamb and for retracting within said housing to unlock the door and jamb;

deadlocking means and means supporting the deadlocking means for pivoting about a pivot point; and control means for pivoting the deadlocking means to a locking position for blocking retracting movement of said bolt means when the door is locked and pivoting the deadlocking means to an unlocking position for allowing the bolt means to be retracted within said housing to unlock the door;

said control means including means for holding said deadlocking means in spaced relation to said bolt means when the bolt means is retracted to its unlocking position so that the deadlocking means will not interfere with sliding extending movement of the bolt means when the bolt means moves from an unlocking to a locking position.

17. A security lock for locking and unlocking a door with respect to a doorjamb, comprising:

a housing;

bolt means slidingly supported within said housing for extending outside the housing to lock said door with respect to said jamb and for retracting within said housing to unlock the door and jamb;

deadlocking means supported at a pivot point for pivotal movement between a locking position for blocking retracting movement of the bolt means to lock the door and an unlocking position for allowing the bolt means to be retracted within the housing to unlock the door, the deadlocking means including a front blocking portion and a rear blocking portion with said pivot point positioned therebetween, said front and rear blocking portions for jointly blocking retracting movement of said bolt means and said rear blocking portion including means for blocking retracting movement of said bolt means by itself;

release lever means for controlling the pivotal movement of said deadlocking means;

operating lever means;

means for pivotally mounting the operating lever means;

lost motion means for connecting an end of said operating lever means to said bolt means in a lost motion relation;

means for slidingly connecting an opposite end of said operating lever means to said release lever means for controlling the movement of the release lever means in response to pivotal movement of the operating lever means; and means for selectively pivotally moving said operating lever means to control the extension and retraction of said bolt means and the pivotal locking and unlocking movement of said deadlocking means.

18. The security lock of claim 17, wherein said means for selectively pivotally moving includes a solenoid for selectively controlling the pivotal movement of said operating lever means in response to electrical control signals.

19. The security lock of claim 17, including means for biasing the release lever means to maintain the locking and unlocking positions of said deadlocking means.

20. The security lock of claim 16, including:

operating lever means;

means for moving the operating lever means over a particular distance within said housing; and means for connecting said operating lever means to said bolt means in lost motion relation, so that in locking the door the operating lever means moves by itself a predefined lost motion distance less than said particular distance and then moves the bolt means over the remaining portion of said particular distance, the remaining portion of said particular distance corresponding to the selected throw length of the bolt means.

21. The security lock of claim 20, wherein said means for connecting includes an aperture formed through said bolt means, and pin means for engaging said operating lever means and extending through said aperture, the aperture dimensioned to allow the pin means and the operating lever means to move freely with respect to said bolt means over said predefined lost motion distance.

22. The security lock of claim 20, wherein said means for moving the operating lever means includes a solenoid for pivotally moving the operating lever means in response to electrical control signals.

23. The security lock of claim 20, wherein said particular distance and said predefined lost motion distance are selected to define a three-quarter inch (1.905 cm) throw length for a bolt means.

24. The security lock of claim 20, wherein said particular distance and said predefined lost motion distance are selected to define a one inch (2.54 cm) throw length for a bolt means.

25. A security lock for locking and unlocking a door with respect to a doorjamb, comprising:

a housing;

bolt means slidingly supported within said housing for extending outside the housing to lock said door with respect to said jamb and for retracting within said housing to unlock the door and jamb;

deadlocking means supported for movement between a locking position for blocking retracting movement of the bolt means to lock the door and an unlocking position for allowing the bolt means to be retracted within the housing to unlock the door;

release lever means connected to said deadlocking means for moving to one position to hold the deadlocking means in said locking position when the door is locked and for moving to another position to hold the deadlocking means in spaced relation to said bolt means when said door is unlocked;

operating lever means connected at one end to said bolt means and at an opposite end to said release lever means for moving to control the extension and retraction of said bolt means and the movement of said release lever means;

lock operation means for selectively applying an actuating force to move said operating lever means for locking and unlocking said door with respect to said jamb; and operating mode means for determining the position of said bolt means with respect to the housing in the absence of said actuating force.

26. The security lock of claim 25, wherein said operating mode means includes spring means connected to said one end of the operating lever means for biasing the bolt means to a predetermined position in the absence of said actuating force.

27. The security lock of claim 25, wherein said lock operation means includes:

a solenoid and link means for connecting the solenoid to said operating lever means; and means for selectively energizing and de-energizing said solenoid to selectively control the movement of said operating lever means.

28. The security lock of claim 27, including local switch means for operating the solenoid to unlock the door and local control means for electrically activating and deactivating the local switch means, the local switch means unlocking the door only when activated by said local control means.

29. The security lock of claim 27, wherein said operating mode means includes a spring for biasing said one end of the operating lever means to extend said bolt means to its locked position when said solenoid is de-energized.

30. The security lock of claim 27, wherein said operating mode means includes a spring for biasing said one end of the operating lever means to retract said bolt means to its unlocked position when said solenoid is de-energized.

31. The security lock of claim 27, wherein said solenoid includes a primary coil and a secondary coil, the security lock further including a solenoid control switch for shunting the secondary coil to allow a maximum current to flow through the primary coil for providing said actuating force for moving the operating lever means to a stationary position, said solenoid control switch including means for connecting the primary coil and secondary coil in series to provide a reduced holding current for holding said operating lever means at said stationary position.

32. The security lock of claim 31, further including thermal protector means for detecting the temperature of said solenoid and for connecting the primary coil and secondary coil in series to provide said reduced holding current when the detected temperature is greater than a predetermined temperature.

33. The security lock of claim 27, further including triggerbolt means slidingly supported within said housing and biased for extending outside the housing when the door is open with respect to the jamb, said triggerbolt means being pressed into said housing when the door is closed with respect to the jamb; and a triggerbolt monitor switch for energizing said solenoid to retract said bolt means when the triggerbolt means is extended.

34. The security lock of claim 25, including holding means for biasing the release lever means to maintain the locking and unlocking positions of said deadlocking means.

35. The security lock of claim 34, wherein said holding means includes a holding pin affixed to said release lever means and a spring having two portions, one portion for biasing the holding pin and release lever means in a first direction to maintain the locking position of said deadlocking means, the second portion for biasing the holding pin and release lever means in a second direction to maintain the unlocking position of the deadlocking means.

36. The security lock of claim 34, including means for adjusting the position of said holding means with respect to said release lever means.

37. The security lock of claim 25, including a deadlocking monitor switch for monitoring the locking or unlocking position of said deadlocking means; and indicator means responsive to said deadlocking monitor switch for indicating the operational position of said deadlocking means.

38. The security lock of claim 37, including means for adjusting the position of said deadlocking monitor switch with respect to said deadlocking means from outside of said housing.

39. The security lock of claim 37, wherein said indicator means includes green lighting means for radiating green light when the deadlocking means is in its locked position, and red lighting means for radiating red light when the deadlocking means is in its unlocked position.

40. The security lock of claim 39, further including a door position switch for monitoring the position of the door, said door position switch having means for operating said red lighting means to radiate red light when the door is open and for operating the green lighting means to radiate green light only when the door is closed and the deadlocking means is in its locked position.

41. The security lock of claim 25, including a bolt monitor switch for monitoring the extended or retracted position of said bolt means; and indicator means responsive to said bolt monitor switch for indicating the extended or retracted position of said bolt means.

42. The security lock of claim 41, wherein said indicator means includes green lighting means for radiating green light when the bolt means is extended and red lighting means for radiating red light when the bolt means is retracted.

43. The security lock of claim 42, further including a door position switch for monitoring the open or closed position of the door, the door position switch having means for operating said red lighting means to radiate red light when the door is open and for operating said green lighting means to radiate green light only when the door is closed and the bolt means is fully extended.

44. The security lock of claim 25, further including triggerbolt means slidingly supported within said housing and biased for extending outside the housing when the door is open with respect to the jamb, said triggerbolt means being pressed into said housing when the door is closed with respect to the jamb.

45. The security lock of claim 44, further including a triggerbolt monitor switch for monitoring the position of the triggerbolt means.

46. The security lock of claim 45, including means for adjusting the position of said triggerbolt monitor switch with respect to the triggerbolt means from outside said housing.

47. The security lock of claim 44, wherein said triggerbolt means includes, a triggerbolt head slidingly supported in said housing for extending from the housing when the door is open and for sliding into the housing when the door is closed, said head having a beveled front surface and a rear surface with a threaded opening formed therein;

a triggerbolt end plate having a threaded hole passing therethrough;

a shaft having a right-hand thread at one end for engaging said head in its threaded opening and having a left-hand thread at its opposite end for engaging said end plate through its threaded hole;

means for slidingly supporting said shaft in said housing; and a coil spring carried on said shaft in concentric relation with the shaft for biasing said head outwardly from said housing;

said shaft rotatable for varying the length of extension of said head from the housing, said head rotatable for positioning said beveled front surface in one of two orientations.

48. The security lock of claim 44, wherein said triggerbolt means includes a backplate for engaging said deadlocking means and biasing the deadlocking means to its unlocked position when the triggerbolt means extends outside the housing, the backplate disengaging from said deadlocking means to allow locking movement of the deadlocking means when the triggerbolt means is pressed into the housing.

49. The security lock of claim 25, wherein said housing includes:

a frontplate for slidingly supporting said bolt means and pivotally supporting said operating lever means;

screws extending into the frontplate;

a faceplate for covering said frontplate and said screws extending into the frontplate; and tamper resistent screws for affixing the faceplate to the cover plate.

50. A security lock for locking and unlocking a door with respect to a doorjamb, comprising:

a housing;

bolt means slidingly supported within said housing for extending outside the housing to lock said door with respect to said jamb and for retracting within said housing to unlock the door and jamb;

deadlocking means supported for pivotal movement between a locking position for blocking retracting movement of the bolt means to lock the door and an unlocking position for allowing the bolt means to be retracted within the housing to unlock the door;

release lever means pivotally supported and connected to said deadlocking means for pivoting the deadlocking means between its locking and unlocking positions;

holding means for biasing the release lever means to maintain the locking and unlocking positions of said deadlocking means;

operating lever means pivotally supported and having lost motion means at one end connected to said bolt means for extending said bolt means a predetermined throw length and for retracting the bolt means when said dead-locking means is in its unlocking position; said operating lever means including cam means at its opposite end connected to said release lever means for controlling the pivotal movement of the release lever means;

a solenoid connected to said operating lever means for selectively pivoting the operating lever means;

means for energizing and de-energizing said solenoid to selectively control the pivotal movement of said operating lever means; and spring means for biasing said operating lever means to provide a particular positioning of said bolt means when said solenoid is de-energized.

51. The security lock of claim 50, wherein said lost motion means includes means for defining a one inch (2.54 cm) throw length for said bolt means.

52. The security lock of claim 50, wherein said lost motion means includes means for defining a three-quarter inch (1.905 cm) throw length for said bolt means.

53. The security lock of claim 50, wherein said lost motion means includes an aperture formed through said bolt means, and pin means for engaging said operating lever means and extending through said aperture to connect the operating lever means and bolt means in lost motion relation.

54. The security lock of claim 50, including means for adjusting the position of said holding means with respect to said release lever means.

55. The security lock of claim 50, wherein said release lever means includes:

a support portion;

means for pivotally supporting the support portion;

an operating arm; and means for adjustably affixing the operating arm to the support portion to allow the position of the arm to be adjusted with respect to the support portion;

said operating arm having a tab at its free end and said deadlocking means including a slot for receiving said tab;

said support portion including a cam slot and said cam means of said operating lever including a guide pin for engaging said cam slot to control the pivotal movement of the support portion.

56. The security lock of claim 50, wherein said deadlocking means includes means for blocking retracting movement of said bolt means at two points located on opposite sides of the pivot point of said deadlocking means.

57. The security lock of claim 50, wherein said bolt means includes an extending lip said deadlocking means includes a mating slot for engaging said lip to block retracting movement of the bolt means, the lip and slot shaped to facilitate disengagement of the bolt means and deadlocking means when the deadlocking means moves from its locking position to its unlocking position.

58. The security lock of claim 57, wherein said lip has two upstanding sides angled at 16° with respect to one another and said slot has walls parallel to the sides of the lip.

59. A security lock for locking and unlocking a door with respect to a doorjamb, comprising:

a housing;

bolt means slidingly supported within said housing for extending outside the housing to an operational position for locking said door with respect to said jamb and for retracting within said housing to an operational position for unlocking the door and jamb;

deadlocking means supported for pivotal movement between a locking position for blocking retracting movement of the bolt means to lock the door and an unlocking position for allowing the bolt means to be retracted within the housing to unlock the door;

release lever means pivotally supported and connected to said deadlocking means for pivoting the deadlocking means between its locking and unlocking positions;

operating lever means pivotally supported and including means for connecting one end to said bolt means and an opposite end to said release lever means;

a solenoid connected to said operating lever means and responsive to energization and de-energization for selectively pivoting the operating lever means to extend and retract said bolt means and pivot said release lever means;

spring means for biasing said operating lever means so that the operating lever means pivots to move the bolt means to a predetermined one of said operational positions when the solenoid is de-energized; and control means for selectively energizing said solenoid with a predetermined bolt actuation current to move the bolt means to the other of said operational positions against the bias of said spring means and for energizing the solenoid with a holding current less than the bolt actuation current to hold the bolt means at said other operational position against the bias of said spring means.

60. The security lock of claim 59, wherein said solenoid includes a primary coil and a secondary coil and said control means includes a solenoid control switch responsive to the position of said bolt means for shunting said secondary coil to allow said bolt actuation current to flow through said primary coil to move the bolt means against the bias of said spring means, the solenoid control switch including means for connecting the primary and secondary coils in series to provide said holding current to maintain the position of the bolt means against the bias of said spring means.

61. The security lock of claim 60, further including a thermal protector means for detecting the temperature of said solenoid and for connecting the primary coil and secondary coil in series to provide said holding current for as long as the detected temperature is greater than a predetermined temperature.

62. The security lock of claim 60, further including means for adjusting the position of said solenoid control switch with respect to said bolt means from outside the housing.

63. The security lock of claim 59, further including a thermal protector means for applying said holding current to said solenoid for a long as the temperature of the solenoid exceeds a predetermined temperature.

64. A security lock for locking and unlocking a door with respect to a doorjamb, comprising:

a housing;

bolt means slidingly supported within said housing for extending outside the housing to lock said door with respect to said jamb and for retracting within said housing to unlock the door and jamb;

deadlocking means supported for pivotal movement between a locking position for blocking retracting movement of the bolt means to lock the door and an unlocking position for allowing the bolt means to be retracted within the housing to unlock the door;

release lever means pivotally supported and connected to said deadlocking means for pivoting the deadlocking means between into its locking and unlocking positions;

operating lever means pivotally supported and including means for connecting one end to said bolt means and an opposite end to said release lever means, the operating lever means pivoting to extend and retract said bolt means and to selectively pivot said release lever means;

lock operation means for selectively applying an actuating force to pivot said operating lever means for locking and unlocking the door with respect to the jamb;

triggerbolt means slidingly supported within said housing and biased for extending outside the housing when the door is open, the triggerbolt means being pressed into said housing when the door is closed;

said triggerbolt means including a backplate for engaging said deadlocking means and biasing the deadlocking means to its unlocked position when the door is open, the backplate disengaging from said deadlocking means to allow locking movement of the deadlocking means when the door is closed; and holding means for biasing the release lever means to maintain the locking and unlocking positions of said deadlocking means.

65. The security lock of claim 64, wherein said holding means includes a holding pin affixed to said release lever means and a spring having two portions, one portion for biasing the holding pin and release lever means in a first direction to maintain the locking position of said deadlocking means, the second portion for biasing the holding pin and release lever means in a second direction to maintain the unlocking position of the deadlocking means.

66. The security lock of claim 64, wherein said backplate has a threaded hole passing therethrough and wherein said triggerbolt means further includes:

a triggerbolt head slidingly supported in said housing for extending from the housing when the door is open and for sliding into the housing when the door is closed, said head having a beveled front end and a rest end with a threaded opening formed therein;

a shaft having a right-handed thread at one end for engaging said head in its threaded opening and having a left-handed thread at its opposite end for engaging said backplate through its threaded hole;

means for slidingly supporting said shaft in the housing; and means for biasing said head outwardly of said housing;

said shaft rotatable for varying the length of extension of said head from the housing.

67. A security lock for locking and unlocking a door with respect to a doorjamb, comprising:

a housing;

bolt means slidingly supported within said housing for extending outside the housing to lock said door with respect to said door jamb and for retracting within said housing to unlock the door and jamb;

deadlocking means supported for pivotal movement between a locking position for blocking retracting movement of the bolt means to lock the door and an unlocking position for allowing the bolt means to be retracted within the housing to unlock the door;

release lever means pivotally supported and connected to said deadlocking means for pivoting the deadlocking means between its locking and unlocking positions;

operating lever means pivotally supported and including means for connecting one end to said bolt means and an opposite end to said release lever means;

a solenoid connected to said operating lever means for selectively pivoting the operating lever means to extend and retract said bolt means and pivot the release lever means; and means for selectively biasing said operating lever means at one of two positions, biasing at one position causing said bolt means to extend to its locked position when said solenoid is de-energized and biasing at the other position causing said bolt means to retract to its unlocked position when said solenoid is de-energized.

68. A security lock for locking and unlocking a door with respect to a doorjamb, comprising:

a housing;

bolt means slidingly supported within said housing for extending outside the housing to an operational position for locking said door with respect to said jamb and for retracting within said housing to an operational position for unlocking the door and jamb;

deadlocking means supported for pivotal movement between a locking position for blocking retracting movement of the bolt means to lock the door and an unlocking position for allowing the bolt means to be retracted within the housing to unlock the door;

release lever means pivotally supported and connected to said deadlocking means for pivoting the deadlocking means between its locking and unlocking positions;

operating lever means pivotally supported and including means for connecting one end to said bolt means and an opposite end to said release lever means;

a solenoid connected to said operating lever means and responsive to energization and de-energization for selectively pivoting the operating lever means to extend and retract said bolt means and pivot the release lever means;

control means for selectively energizing said solenoid at one magnitude of current to move the bolt means to one of said operational positions and for energizing the solenoid at a second reduced magnitude of current to hold the bolt means at said one operational position, said control means including means for de-energizing the solenoid to allow said bolt means to move to the other of said operational positions; and thermal protector means for operating said control means to energize the solenoid at said reduced magnitude of current for as long as the temperature of the solenoid exceeds a predetermined temperature.

69. A security lock, comprising:

a housing;

bolt means for extending outside said housing to a locking position and for retracting into said housing to an unlocking position;

a solenoid for controlling the movement of said bolt means between its locking and unlocking positions; and means for selectively applying electric current to energize and de-energize said solenoid and thereby control the movement of said bolt means;

said solenoid including a primary coil, a secondary coil and switch means for shunting the secondary coil to allow a predetermined actuation current to flow through the primary coil and provide an actuating force for moving said bolt means to one of said positions, said switch means including means for connecting the primary and secondary coils in series to provide a holding current less than said actuation current for holding the bolt means at said one position.

70. The security lock of claim 69, further including thermal protector means for detecting the temperature of said solenoid and for connecting the primary coil and secondary coil in series to provide said reduced holding current when the detected temperature is greater than a predetermined temperature.

71. The security lock of claim 44, wherein said triggerbolt means includes:

a triggerbolt head;

a triggerbolt end plate having a threaded hole passing therethrough;

a shaft slidingly supported in said housing, said shaft having means at one end for connecting to said triggerbolt and having threads at its opposite end for engaging said threaded hole of said end plate; and means for biasing said triggerbolt head outwardly of said housing to extend said head out of the housing a distance determined by the position of said end plate on said shaft, said shaft being rotatable for varying the length of extension of said triggerbolt head from said housing.

72. The security lock of claim 71, wherein said shaft includes means at said one end for rotatively engaging said triggerbolt head to allow selective positioning of the head at a desired orientation.

73. In a door lock having a housing and a triggerbolt which extends outwardly of the housing when a door is open and which is pressed inwardly into the housing when the door is closed, the improvement comprising:

a triggerbolt head extending from said housing;

a shaft slidingly supported within said housing and engaged at one end with said triggerbolt head;

an end plate threadingly engaged with the opposite end of said shaft;

means for biasing said triggerbolt head outwardly of the housing; and stop means within said housing for engaging said end plate to fix the extended position of the triggerbolt head;

said shaft being rotatable for selectively adjusting the axial position of the end plate on said shaft and thereby selectively adjusting the extension of said triggerbolt head from said housing.

74. The door lock of claim 73, further including means for rotatively connecting said shaft and triggerbolt head so that the head can be rotated to a desired orientation with respect to said housing.

* * * * *